US006491579B1

(12) United States Patent
O'Hagin

(10) Patent No.: US 6,491,579 B1
(45) Date of Patent: Dec. 10, 2002

(54) ROOF VENTILATION SYSTEM AND METHOD

(76) Inventor: Harry T. O'Hagin, 2661 Gravenstein Hwy., Suite 107, Sebastopol, CA (US) 95472

( * ) Notice: Subject to any disclaimer, the term of this patent is extended or adjusted under 35 U.S.C. 154(b) by 0 days.

(21) Appl. No.: 09/565,983

(22) Filed: May 4, 2000

Related U.S. Application Data

(63) Continuation of application No. 08/960,166, filed on Oct. 27, 1999, which is a continuation of application No. 07/924,738, filed on Aug. 4, 1992, now abandoned.

(60) Provisional application No. 60/133,244, filed on May 4, 1999.

(51) Int. Cl.[7] ..... F24F 7/02

(52) U.S. Cl. ..... 454/250; 52/198; 52/199; 454/339; 454/366; 454/367

(58) Field of Search ..... 454/250, 339, 454/365, 366, 367, 368, 185; 52/198, 199

(56) References Cited

U.S. PATENT DOCUMENTS

| | | | |
|---|---|---|---|
| 938,930 | A | 11/1909 | Wiest |
| 1,381,630 | A | 6/1921 | Goodrich |
| 1,496,670 | A | 6/1924 | Floyd |
| 2,692,548 | A | 10/1954 | Knorr |
| 2,905,072 | A | 9/1959 | Oswald |
| 3,093,059 | A | 6/1963 | Metz |
| 4,090,435 | A | 5/1978 | Vallee |

(List continued on next page.)

FOREIGN PATENT DOCUMENTS

| | | | |
|---|---|---|---|
| DE | 2128035 | | 12/1972 |
| EP | 0 695 839 | | 2/1996 |
| FR | 911724 | | 7/1946 |
| FR | 2 476 722 | | 8/1981 |
| FR | 2 683 570 | | 5/1993 |
| FR | 2 683 571 | | 5/1993 |
| FR | 2 687 181 | | 8/1993 |
| FR | 2 698 902 | | 6/1994 |
| GB | 593645 | | 10/1947 |
| GB | 1 366 505 | | 11/1973 |
| GB | 1 393 977 | | 5/1975 |
| GB | 1 591 627 | | 6/1981 |
| GB | 2 145 131 | A | 3/1985 |
| GB | 2 199 860 | A | 7/1988 |
| GB | 2 236 775 | A | 4/1991 |
| GB | 2 243 169 | A | 10/1991 |
| GB | 2 262 295 | A | 6/1993 |
| GB | 2 262 949 | A | 7/1993 |
| GB | 2 271 585 | A | 4/1994 |
| GB | 2 288 277 | A | 10/1995 |
| NL | 9000176 | | 8/1991 |
| WO | WO 98/15701 | | 4/1998 |
| WO | WO 9945327 | | 9/1999 |

*Primary Examiner*—Harold Joyce
(74) *Attorney, Agent, or Firm*—Knobbe, Martens, Olson & Bear, LLP

(57) ABSTRACT

A ventilation system for an attic or rafter space that mimics the appearance of the roofing material and thus has little effect on the appearance of the building. In one aspect primary vents are installed in the roof deck below the roof tiles, and the roof tiles are mounted to as to provide air spaces in between them and thus allow air flow from the primary vents to the outside. In another aspect a secondary vent is constructed to look like the surrounding field tiles and is installed over each primary vent. One or more vent openings in the secondary vent and an opening in the primary vent conduct air between the attic or rafter space and the outside. The secondary vent has a frame with one or more vent openings and a cap covering each opening shielding the ventilating space. Frames are formed in one piece and are made to fit each different size and type of roofing tile. The caps and the frame are ribbed for rigidity. The caps are made in one size only to minimize manufacturing and inventory complexity, thus any cap may be fitted on any frame.

97 Claims, 18 Drawing Sheets

U.S. PATENT DOCUMENTS

| | | | | |
|---|---|---|---|---|
| 4,297,818 | A | 11/1981 | Anderson | 52/199 |
| 4,498,267 | A | 2/1985 | Beck | 52/555 |
| 4,803,816 | A | 2/1989 | Klöber | 52/219 |
| 4,899,505 | A | 2/1990 | Williamson et al. | 52/199 |
| 5,054,254 | A | 10/1991 | Sells | 52/199 |
| 5,326,318 | A | 7/1994 | Rotter | 454/365 |
| 5,549,513 | A | 8/1996 | Thomas et al. | 454/365 |
| 5,593,348 | A | 1/1997 | Rickert | 454/365 |
| 5,697,842 | A | 12/1997 | Donnelly | 454/365 |
| 5,738,581 | A | 4/1998 | Rickert et al. | 454/365 |
| 5,766,071 | A | 6/1998 | Kirkwood | 454/185 |

FIG. 17
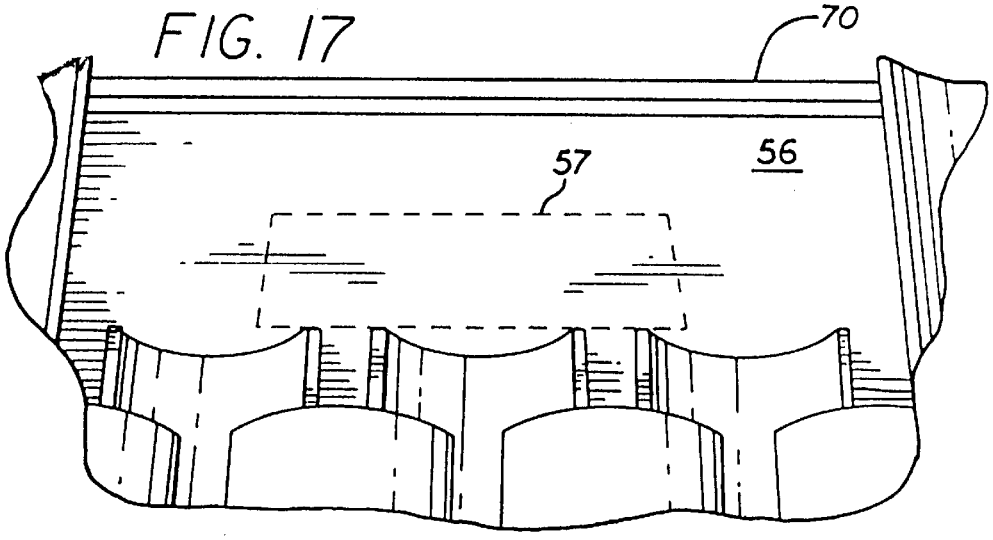
FIG. 18
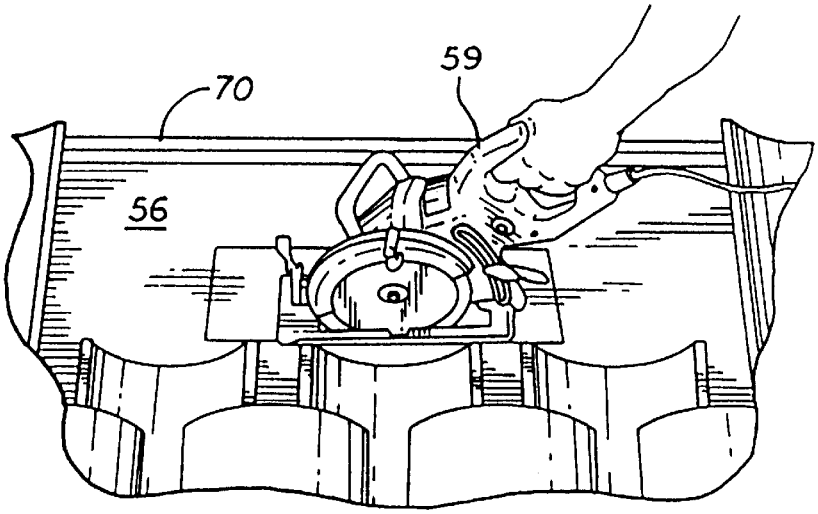
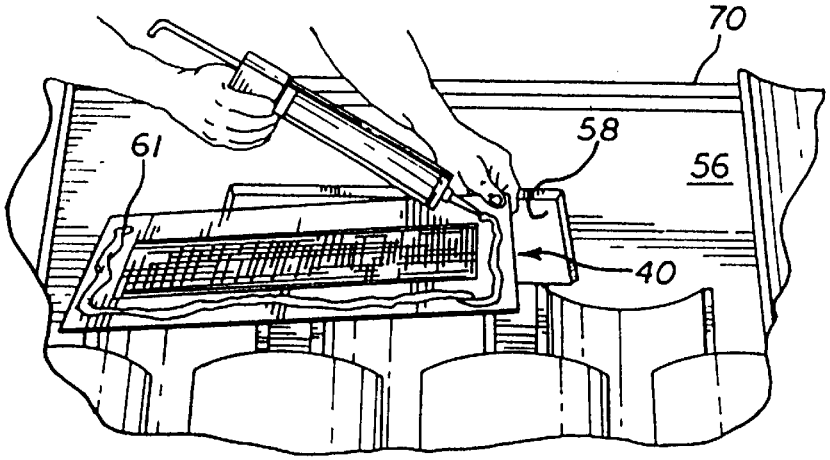
FIG. 19

20
20
18
18
34
34
50
50
12
70
40
46
45
45

FIG. 22
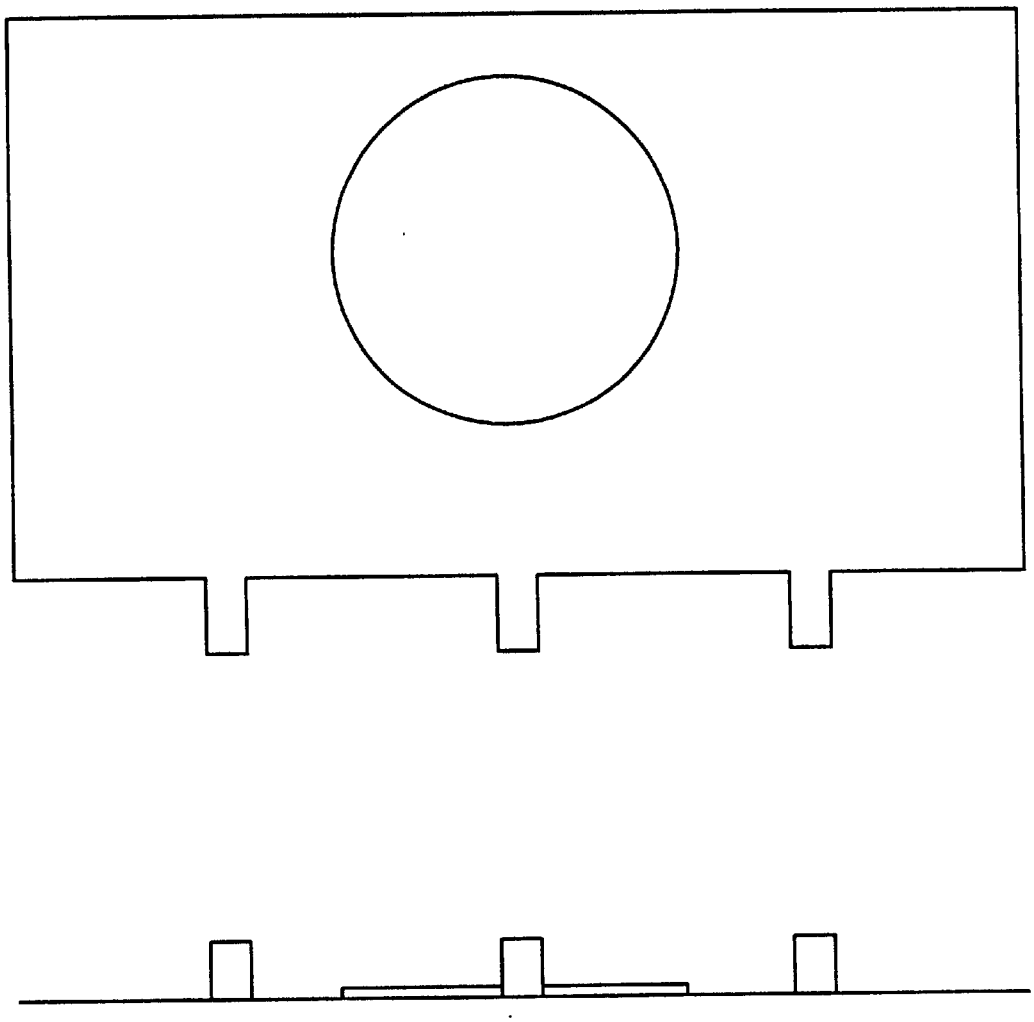
FIG. 23
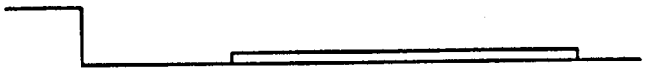
FIG. 24

ROOF VENTILATION SYSTEM AND METHOD

RELATED APPLICATIONS

This application is a continuation of copending U.S. patent application Ser. No. 08/960,166 filed Oct. 27, 1997 which is a continuation of U.S. patent application Ser. No. 07/924,738 filed Aug. 4, 1992 abandoned, and provisional application Serial No. 60/133,244 filed May 4, 1999.

BACKGROUND OF THE INVENTION

1. Field of the Invention

This invention relates to roof vents, and more specifically to passive attic vents for use with tile roofs.

2. Description of the Prior Art

Energy efficiency is a serious consideration in building design and construction. Many building codes require builders to minimize energy requirements to maintain comfortable living spaces. One of the most common energy losses in a home is due to heat transfer through the attic. In warm climates, heat builds up in the attic from solar energy incident on the roof or from heat transfer up from the living space. If the attic is allowed to become too hot, the installed insulation becomes ineffective and the attic heat is transferred to the living space below. In colder climates, moisture builds up in the attic, robbing the insulation of much of its R value. Consequently valuable heat in the living space is conducted out through the attic.

Early efforts at minimizing energy losses through the attic focused on the insulation between the living space and the attic and ignored the effects of the heat and/or moisture build-up. As insulation improved a point was reached where more insulation was not necessarily better or possible due to space limitations. Gable vents and dormer type passive ventilation systems have been incorporated to ventilate the attic. These ventilation devices conduct excess heat and or moisture out or the attic thus maintaining the efficiency of the installed insulation. However, both gable and dormer ventilation systems are clearly visible and often require extensive architectural manipulation to minimize their esthetic effect on the structure.

In geographical areas that are typically warm and dry such as the American Southwest, many homes have low pitch, hip roofs which have no gables, and dormers may have a significantly effect the aesthetics of a design if improperly located or too numerous. Therefore, these systems have proven to be inadequate. In colder and or wetter climates such as the Eastern United States, snow buildup, or driven snow or rain counteract the conventional passive ventilation devices and usually block the vents and or reintroduce more moisture than was originally present thus minimizing the benefit of the vents.

Passive attic vents which attempted to camouflage their appearance have been marketed in recent years. These camouflaged vents are generally a closed device made for direct conduction of air from the attic or waste vents and are often made of plastic or other material amenable to mold manufacturing. The direct conduction or one-piece construction may limit air flow and may provide a direct path for moisture such as driven rain or snow into the attic thus minimizing the benefit of the vent. To improve the conventional ventilation technology it is necessary to understand clay or concrete roof construction.

A roof is designed to shed rain and snow and shield the living space from sun. A roof is composed of structural elements to support its weight and form a slope to assist in shedding rain and snow.

The first structural element is the roof rafter 8 or truss which creates the basic slope of the roof as shown in FIGS. 7 and 8. Secured on top of the rafters or trusses, such as rafter 8, is a layer of wood 6, such as planks, plywood or oriented strand board (OSB). Nailing plywood 6 to the roof rafters forms a sloped diaphragm or structural layer D.

Structural layer D forms a very strong structural element and is likely to leak only along the seams between sheets of plywood 6 if left as the complete roof. However, wood requires frequent attention and treatment to retain its weather resistance, and thus is not a good long term roof material.

Plywood 6 is usually covered with lapped layers of roofing felt 4 or paper or other suitable material which is treated with tar and or other chemicals to render it water resistant. The lapped layers of felt 4 may become sealed together by the heat on the roof and form a true water proof membrane or layer and could be used for a roof topping. However conventional roof felt or paper such as felt 4 is fairly fragile and susceptible to damage from sun or wind. If left unshielded in the sun it would dry and crack in a short time and thus is inadequate as a lone weatherproofing material.

By covering felt 4 with a layer of material resistant to sun and other weather effects, felt 4 may be protected from direct solar radiation and may produce a weather-tight roof. Layer 2 may be composed of asphalt shingles, wood shingles, clay tiles, concrete tiles, metal tiles or similar conventional materials. In this example, layer 2 is composed of interleaved clay tiles such as cap tiles 2C and pan tiles 2P. Battens, such as batten B, may be used as securing sites for metal, clay or concrete tile roofs.

Layer 2 sheds the majority of rain and snow and is generally impervious to long term weather effects. Layer 2 does have many small openings and spaces between the tiles or other elements, thus felt 4 remains as the waterproof layer and sheds any water or snow which passes through layer 2.

Referring now to FIG. 8, conventional camouflaged vents, such as vent 7, provide a direct and closed conduction path P for attic air or waste vent air. In a passive ventilation system, the volume of air conducted via path P is limited by the cross sections at opening O and inlet I and the temperature differential between the air AI in the attic and air AO outside the attic. To permit adequate attic ventilation, many conventional vents, such as vent 7, will be needed. Due to the directness of path P, wind driven rain or snow may be blown into opening O and travel directly into the underlying attic space bypassing tile layer 2 and water proof felt layer 4.

Due to the complex shapes required, conventional camouflaged vents, such as vent 7 are often fabricated from moldable materials such as plastics. Plastic permits a vent to survive moisture yet may not be as durable as conventional roofing materials due to the effects of solar radiation and/or airborne chemicals.

What is needed is a new roof system incorporating an improved passive ventilation system that can be simply manufactured from highly durable material and will not affect the appearance of a building design if used in adequate numbers to properly ventilate the attic and or rafter spaces, and is useable on many roof configurations and with many types of conventional roofing materials.

SUMMARY OF THE INVENTION

The present invention provides a new roofing system that incorporates an open attic or rafter space ventilation technique. The new roofing system includes solid conventional roofing materials such as clay or concrete tiles combined with two or more primary vents conducting air through the structural layer and the water resistant membrane.

Thus, in a first aspect, the present invention provides a ventilated roof comprising a roof structural layer through which air is to be ventilated; a primary vent disposed in the structural layer to provide an air flow passage therethrough having a first venting performance; a plurality of tiles mounted on the structural layer to form a tile layer thereover and arranged to provide air flow passages between adjacent tiles having a combined second venting performance; and a secondary vent disposed in the tile layer to form an outer roofing layer therewith and having an air passage therethrough with a third venting performance smaller than the first venting performance, the outer roofing layer being in air flow communication with the primary vent to provide a venting air flow passage for venting said air.

In another aspect, the present invention provides a method for ventilating a roof comprising the steps of providing a roof structural layer through which air is to be ventilated; selecting a primary vent having a first venting performance; mounting the primary vent in the structural layer to provide an air flow passage therethrough; selecting a plurality of tiles; arranging the tiles on the structural layer to provide air flow passages between adjacent tiles; mounting the tiles on the structural layer to form a tile layer thereover having a combined second venting performance; selecting a secondary vent having an air passage therethrough with a third venting performance smaller than the first venting performance; and mounting the secondary vent in the tile layer to form an outer roofing layer therewith in air flow communication with the primary vent to provide a venting air flow passage for venting said air.

In yet another aspect, the present invention provides a ventilated roof comprising a roof structural layer through which air is to be ventilated from an attic; a primary vent disposed in the structural layer to provide an air flow passage therethrough having a first venting performance; a plurality of tiles mounted on the structural layer to form a tile layer thereover and arranged to provide air flow passages between adjacent tiles having a combined second venting performance; and a secondary vent disposed in the tile layer to form an outer roofing layer therewith and having an air passage therethrough with a third venting performance, the outer roofing layer being in air flow communication with the primary vent to provide a venting air flow passage having a fourth venting performance greater than the second venting performance for venting the air from the attic.

In a further aspect, the present invention provides a method for ventilating a roof comprising the steps of providing a roof structural layer through which air is to be ventilated; selecting a primary vent having a first venting performance; mounting the primary vent in the structural layer to provide an air flow passage therethrough; selecting a plurality of tiles; arranging the tiles on the structural layer to provide air flow passages between adjacent tiles; mounting the tiles on the structural layer to form a tile layer thereover having a combined second venting performance; selecting a secondary vent having an air passage therethrough with a third venting performance; and mounting the secondary vent in the tile layer to form an outer roofing layer therewith in air flow communication with the primary vent to provide a venting air flow passage having a fourth venting performance greater than the second venting performance for venting said air.

In a still further aspect, the present invention provides a ventilated roof comprising a roof structural layer through which air is to be ventilated; a primary vent disposed in the structural layer to provide an air flow passage therethrough having a first venting performance; and a plurality of tiles mounted on the structural layer to form a tile layer thereover and arranged to provide air flow passages between adjacent tiles in air flow communication with the primary vent to vent the air and having a combined second venting performance.

In yet another further aspect, the present invention provides a method for ventilating a roof comprising the steps of providing a roof structural layer through which air is to be ventilated; selecting a primary vent having a first venting performance; mounting the primary vent in the structural layer to provide an air flow passage therethrough; selecting a plurality of tiles; arranging the tiles on the structural layer to provide air flow passages between adjacent tiles in air flow communication with the primary vent; and mounting the tiles on the structural layer to form a tile layer thereover having a combined second venting performance.

In still another aspect, the present invention provides a ventilated roof comprising a first roofing layer having a primary vent through which air from an attic is to be ventilated, and a second roofing layer constructed from a plurality of similar roofing tile elements disposed over the first roofing layer and having an effective third vent in air flow communication with the primary vent to vent said attic, said effective third vent combining air flow passages between the tile elements.

And in yet another aspect, the present invention provides a method for ventilating a roof comprising the steps of selecting a first roofing layer having a primary vent through which air from an attic is to be ventilated; selecting a plurality of similar roofing tile elements; and disposing the tile elements over the first roofing layer to form a second roofing layer having an effective third vent in air flow communication with the primary vent to vent said attic, said effective third vent combining air flow passages between the tile elements.

Another aspect of the present invention combines new, easy to manufacture, unitary structural ventilation tiles or secondary vents into the roof shield layer over a water resistant roof layer. The primary vent or vents may be sized large enough to benefit from the secondary ventilation in addition to the primary, rafter space ventilation.

The new tile or secondary vent tile may be of hollow construction using durable materials such as steel, copper, aluminum, or any other suitable material. The secondary vent tile provides some secondary attic ventilation through the roof shield layer in addition to the primary ventilation provided by the permeability of the roof shield layer. The interaction of the one or more primary vents and the secondary vent(s) in the roof shield layer and the permeability of the roof shield layer generate greater air flow from an enclosed air space such as an attic or rafter space due to a given pressure or temperature differential than the calculated net free ventilation area (NFVA) of the primary vents would anticipate.

In another aspect of the present invention one or more secondary vents in the roof shield layer may be generally co-located with one or more primary vents in the weatherproof roof structural layer.

In another aspect of the present invention the unitary structural vent tile or hollow tile is easily manufactured and is as easily installed as a conventional roof tile. A structural vent tile or hollow tile according to the present invention may be made from a contiguous piece of material thus minimizing hand labor and resulting in greater manufacturing efficiency.

In another aspect of the present invention one or more primary vents may be located to maximize airflow from the attic and one or more structural ventilation tiles or secondary vents may be located to minimize visual awareness of their presence and/or provide adequate secondary ventilation and prohibit direct ingress of water, snow or other foreign material through the structural ventilation tile(s) and one or more primary vents into the attic.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 17 is a perspective view of a mounting location for a primary vent showing the hole marked on the roof;

FIG. 18 is a perspective view of a mounting location for a primary vent showing the hole being cut in the roof;

FIG. 19 is a perspective view of a mounting location for a primary vent showing the primary vent being prepared for installation;

FIG. 22 is a top view of a second element composing a flat structural vent according to the present invention;

FIG. 23 is a front view of the element of FIG. 22;

FIG. 24 is a side view of the element of FIG. 22;

DETAILED DESCRIPTION OF THE PREFERRED EMBODIMENTS

Figure 1:
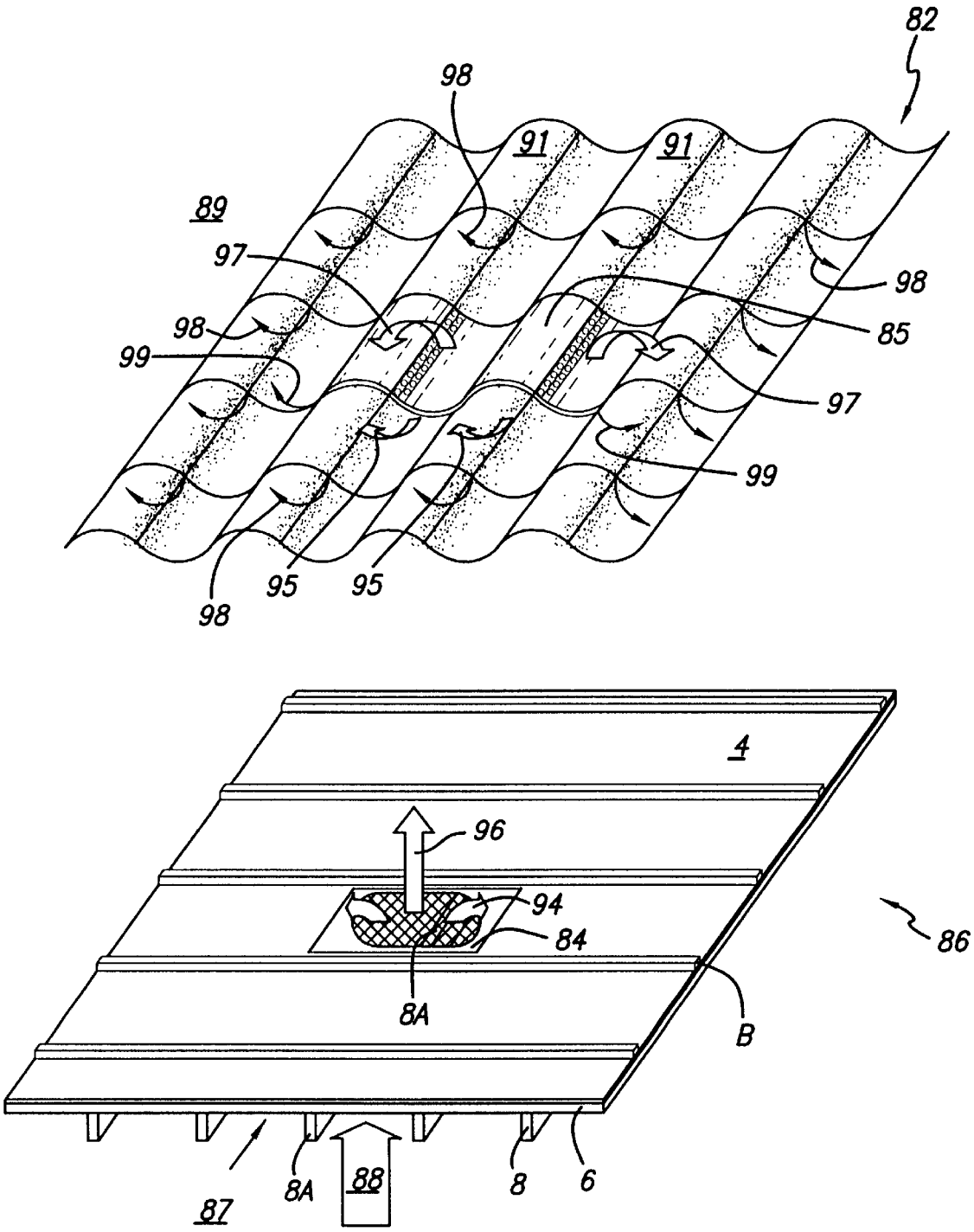
FIG. 1 is an expanded isometric view of a section of roof according to the present invention.

Referring now to FIG. 1, new roof system 80 is shown according to a currently preferred embodiment of the present invention. Roof system 80 includes roof shield layer 82 and one or more primary vents such as primary vent 84. Roof system 80 may be installed on any conventional water resistant roof layer such as roof structural layer 86. Roof shield layer 82 may be composed of conventional, solid tiles such as tiles 91, or a combination of solid tiles and hollow structural tiles such as tile 85. Conventional tiles 91 may be produced from any suitable material such as clay concrete, slate, or metal.

Figure 2:
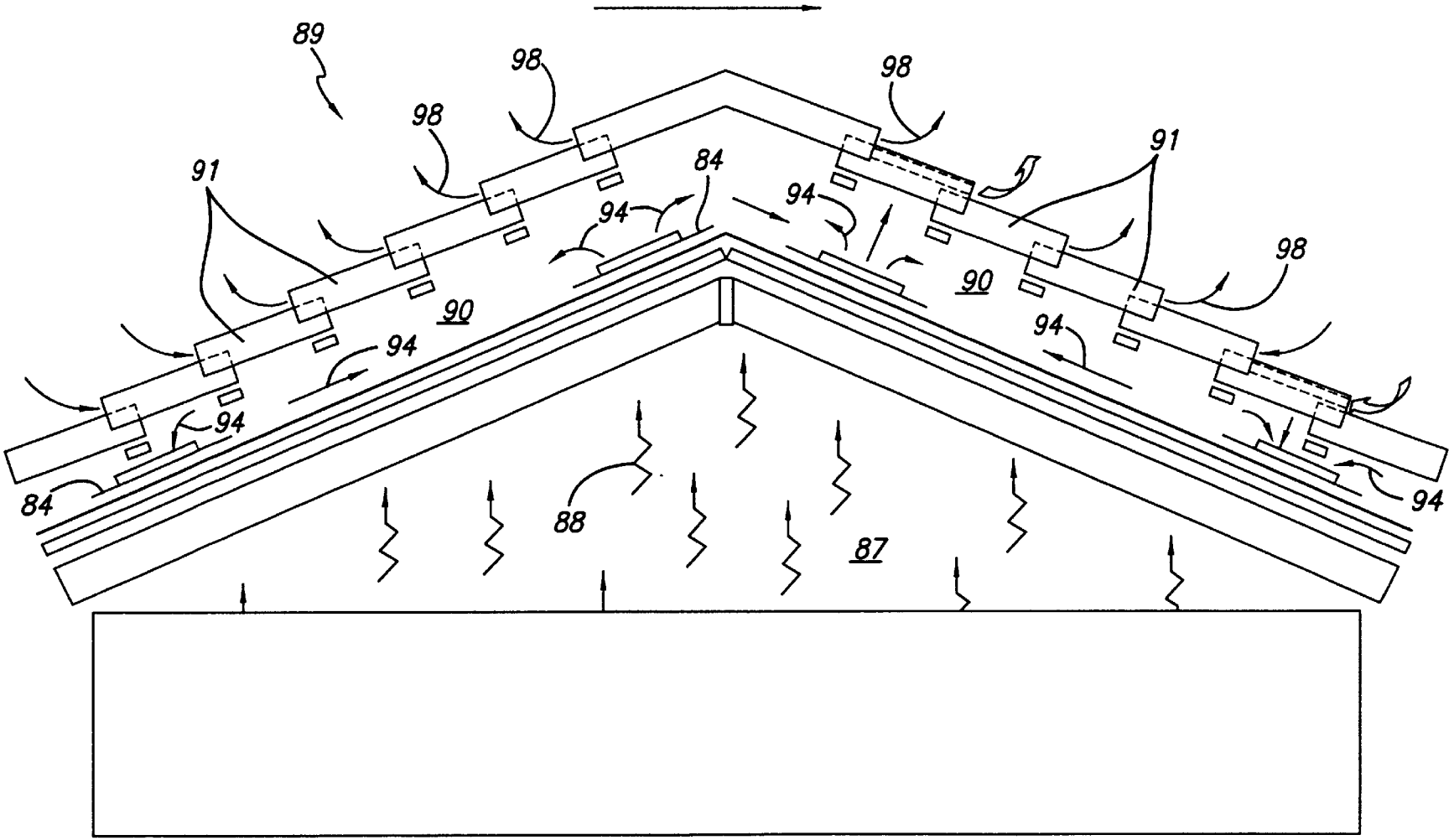
FIG. 2 is a partially exploded section view of a roof according to the present invention.

Referring now to FIG. 2, attic air 88 may be drawn through one or more primary vents such as primary vent 84 by a pressure or temperature differential between attic or enclosed airspace 87 and outside airspace 89. Once attic air 88 is drawn through primary vent 84 it enters a ventilation layer or twining chamber 90. In a first embodiment of the present invention, outbound primary ventilation flow 94 passes through roof shield layer 82 as exhaust air 98 to complete attic ventilation. It should be noted that this discussion focuses on an outbound flow of air, but similar pathways and dynamics exist for an inbound flow of air.

In this embodiment of the invention, roof shield layer 82 is formed of tiles or other suitable roof shield elements that are disposed with respect to one another so as to cover structural layer 86 and protect it from the effects of weather, and also to provide air flow passages between the tiles to allow air flow into and out of ventilation layer 90. Thus, in one embodiment of the invention each tile 91 is disposed with the downslope edge overlying the upslope edge of the adjacent downslope tile, in a manner well known in the art, and spaced from the upslope edge of the adjacent tile by a sufficient distance to create an air flow passage therethrough. The distance between overlapping edges of adjacent tiles need not be great, as the combined effect of such air flow passages over the entire surface of roof shield layer 82 can be significant. Therefore merely providing cracks between overlapping tile edges may be enough to effectuate a combined venting performance sufficient to effectively exhaust any air 88 pushed through from, or sucked into, attic 87. Additionally, roofs will typically not be sealed around their edges, and these edges will therefore also act as air flow passages to and from ventilation layer 90. The term "venting performance" as used above and in the claims is understood to encompass any measure or definition of air flow, including but not limited to a measure of the effective or total cross sectional area, the effective air flow volume, or the effective air flow speed.

In another embodiment of the present invention, roof shield layer 82 may include hollow vent tiles such as tile 85 to improve the efficiency of ventilation. As air 88 is drawn out through primary vent 84 it may be diverted by tiles 91 or one or more diverters such as frame diverters 92 shown in FIGS. 15, 25A and 25C. Diverters such as frame diverters 92 divide attic air 88 into twining or primary flow 94 and secondary flow 96. Primary flow 94 circulates within ventilation layer 90 and is exhausted as exhaust air 98 through the cracks or openings provided over the entirety of roof shield layer 82, as detailed above. With reference once again to FIG. 1, secondary flow 96 is directed through any generally co-located secondary structural tiles such as tile 85 to exhaust through the sides as side air 99, through the front as front air 95, or through the top as top air 97. Thus the total air exhausted from attic 87 may be expressed as TA and is shown in equation 100.

$$100 \longrightarrow T_A = (\text{secondary flow } 96) + \text{primary flow } 94$$
$$= (\text{top air } 97 + \text{front air } 95 + \text{side air } 99) + \text{exhaust air } 98$$

Figure 3:
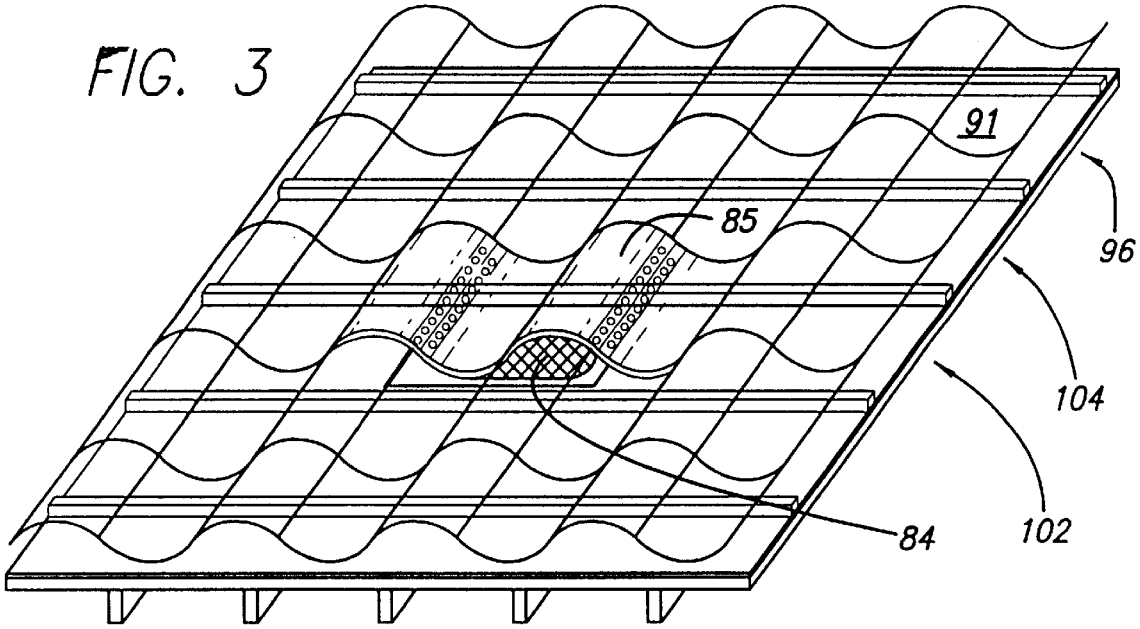
FIG. 3 is a condensed isometric view of the roof of FIG. 1.

Referring now to FIG. 3, roof shield layer 82 is shown directly connected to structural layer 86. Vent tile 85 may be located above any primary vent 84 as shown in FIG. 3 to prevent a broken tile directly above a primary vent from allowing water to pass directly through into enclosed space or attic 87. Conventional tiles 91 adjacent to tile 85 are shown as clear to permit a view of the installed interrelationship between the elements of roof shield layer 82 and the elements of structural layer 86. Primary vent 84 is shown installed directly below vent tile 85. To exploit the ventilation efficiency of the present invention, vent tile 85 may be installed in any of the illustrated locations of row 102, row 104, or row 106, and thus take advantage of the natural updraft created by rising attic air 88, which will typically be warmer than outside airspace 89.

Figure 4:
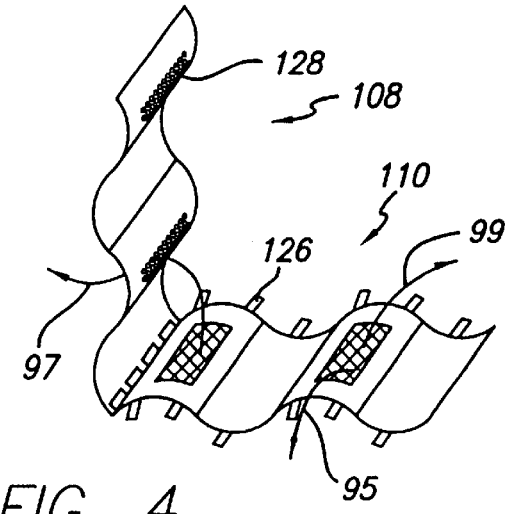
FIG. 4 is a detail view of a hollow 'S' tile according to the present invention.

Referring now to FIG. 4, a hollow tile such as tile 85 may be formed of two generally similar parallel surfaces such as upper surface 108 and lower surface 110 forming a hollow tile of generally similar size and shape to conventional roof tiles such as solid tiles 91. Top air 97 may be allowed to escape through ventilation apertures 128 such as louvers, holes or other openings. Thus, it must be noted that due to the novel design of the invention, the venting performance (as measured by, e.g., the total effective cross-sectional area) of any such openings formed in all secondary vent tiles 85 installed in a roof according to the invention can be significantly smaller than the venting performance of all primary vents 84 formed in the structural elements 86 of the roof, and yet provide for adequate ventilation of all attic air 88 passing through the primary vents. This is a beneficial result of the use of air passages disposed between adjacent tiles which, as discussed above, can provide a substantial amount of air flow therebetween. Thus, exhaust apertures 128 formed in secondary vent tiles 85 according to the invention will provide a significantly smaller effective surface area exposed to outside airspace 89 than conventional roof ventilation systems that require vent openings formed in the outer surface of the roof shield layer that are approximately equal in total surface area to the primary vents in ventilating communication with the attic. This is advantageous because smaller outside apertures provide less opportunity for ingress of water, snow or other foreign material through the structural ventilation tile(s) and one or more primary vents into the attic.

Figure 5:
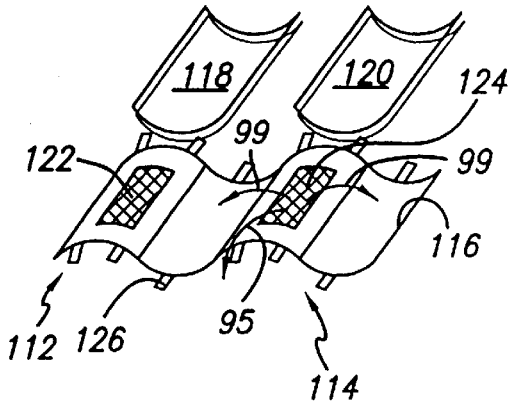
FIG. 5 is an alternate embodiment of the tile of FIG. 4.
Figure 6:
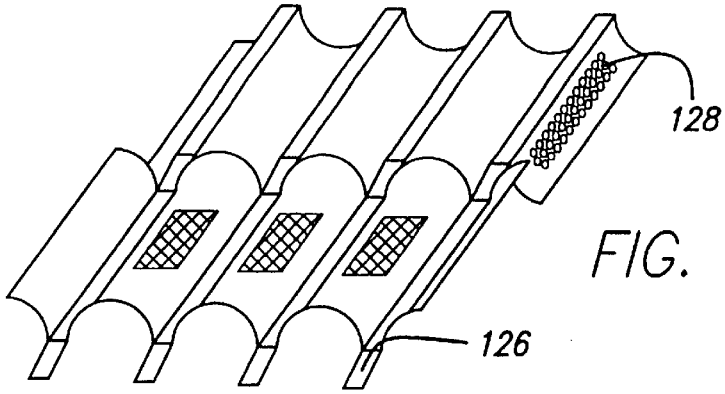
FIG. 6 is a detail view of a hollow 'M' tile according to the present invention.
Figure 8:
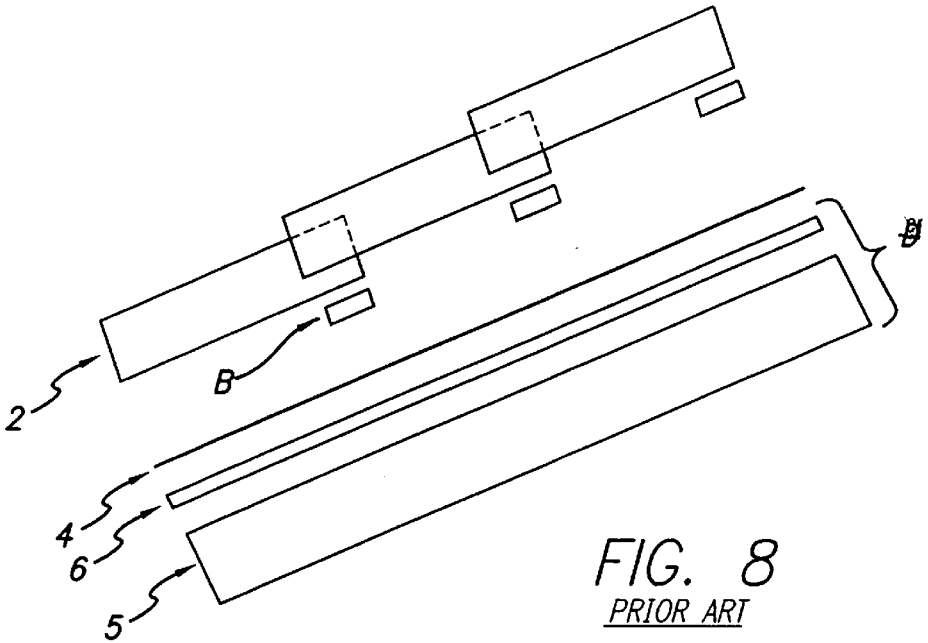
FIG. 8 PRIOR ART
FIG. 8 is a side view of the roof of FIG. 7 taken along X–X'.
Figure 9:
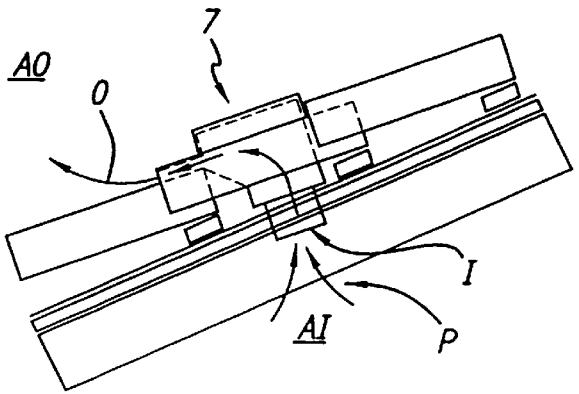
FIG. 9 PRIOR ART
FIG. 9 side view of a conventional closed system vent installed on a tile roof.
Figure 7:
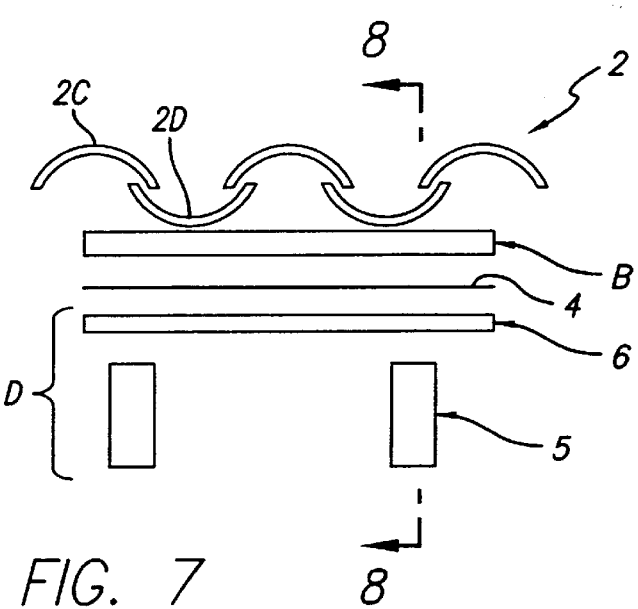
FIG. 7 PRIOR ART
FIG. 7 is an exploded end view of the component parts of a conventional tile roof.

Referring now to FIG. 5, in an alternate embodiment of the invention two hollow cap tiles such as tiles 112 and 114 may be formed on a single 'S' shaped frame such as frame 116 by attaching, folding or otherwise forming caps 118 and 120 over ventilation access 122 and 124 respectively. In the tiles of FIGS. 5 and 6, the upper surfaces and the lower surfaces are separated and supported by spacers or tabs such as tabs 126. In an alternate embodiment an 'M' style tile may be formed as shown in FIG. 6. A similar 'flat' hollow tile may be constructed using elements shown in FIGS. 21A–24.

Figure 10:
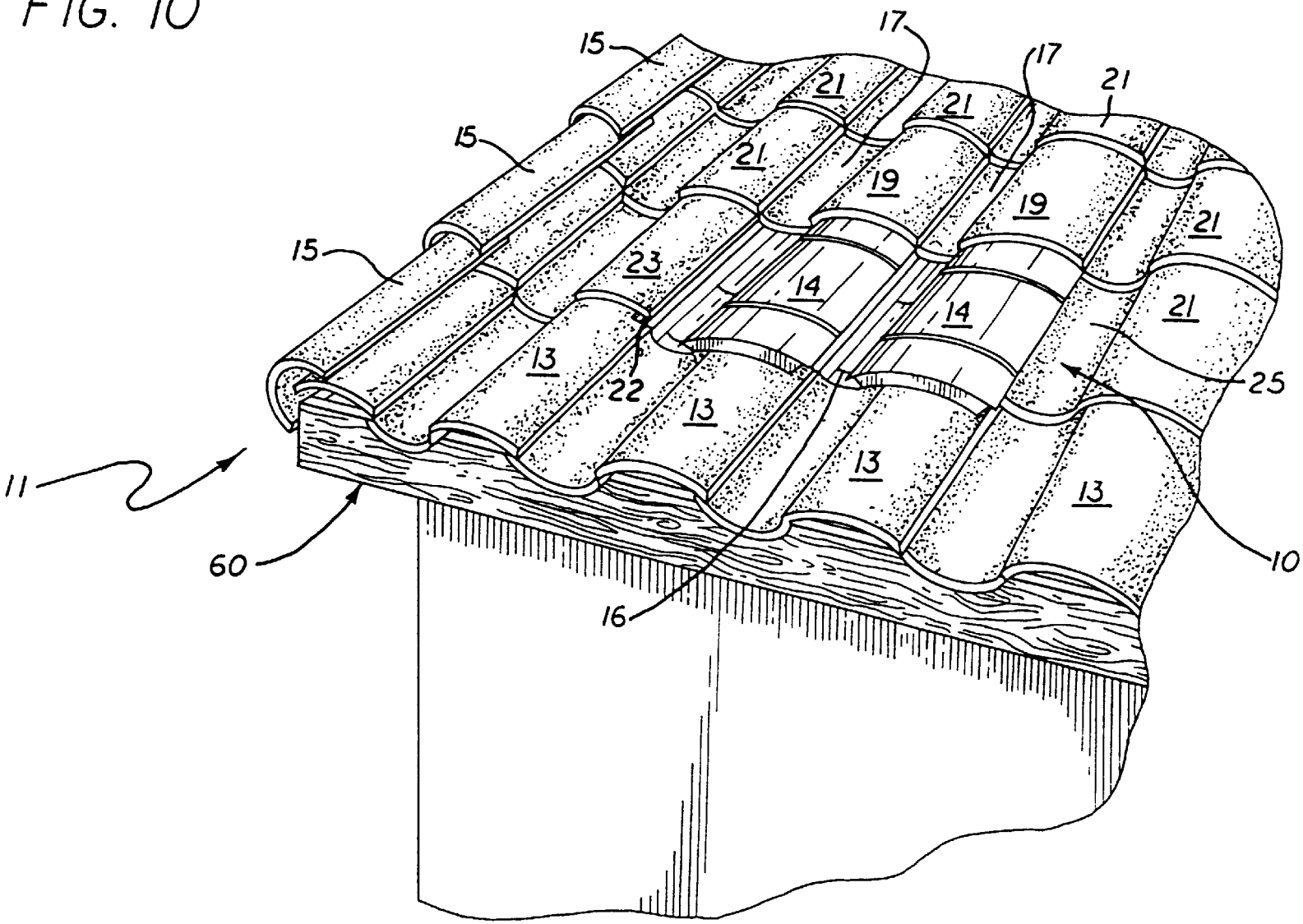
FIG. 10 is a perspective view of a secondary vent frame and caps, according to the present invention, installed on a portion of a roof.

Referring to FIG. 10, a section of pitched roof 11 near eave 60 is shown including a roof vent 10 according to another embodiment of the present invention. Pitched roof 11 is generally composed of a plurality of conventional tiles 21, surrounded by edge tiles 13, edge caps 15 and ridge caps (not shown). Roof vent 10 is in two parts, primary vent 40 (shown in FIG. 20) and secondary vent 12. Roof vent 10 may be formed from any suitable metal such as aluminum, steel, or copper. In a currently preferred embodiment of the present invention roof vent 10 may be formed of 26 gauge galvanized steel.

Figure 11:
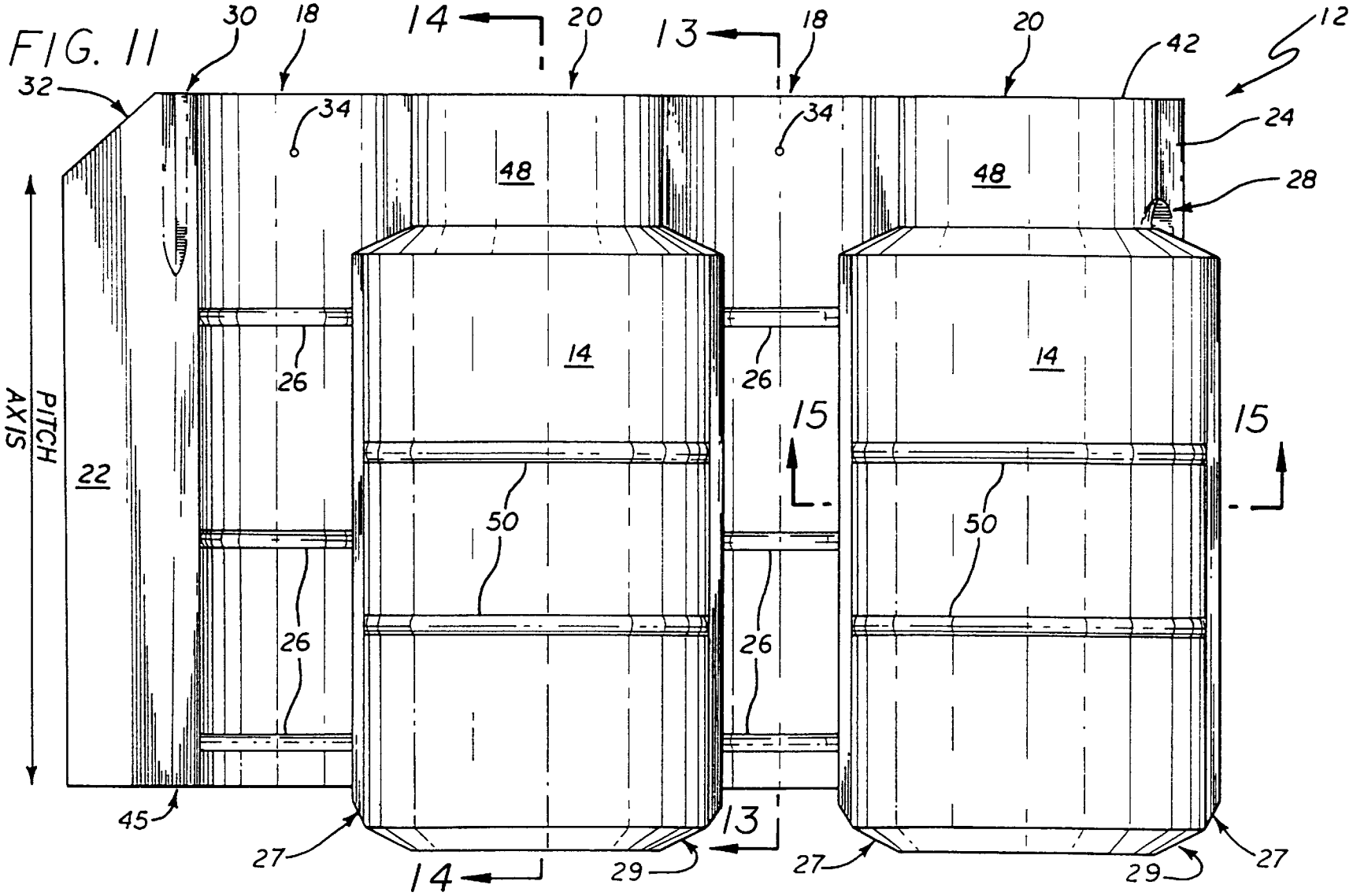
FIG. 11 is a top view of a secondary vent frame and caps according to the present invention.
Figure 25A:
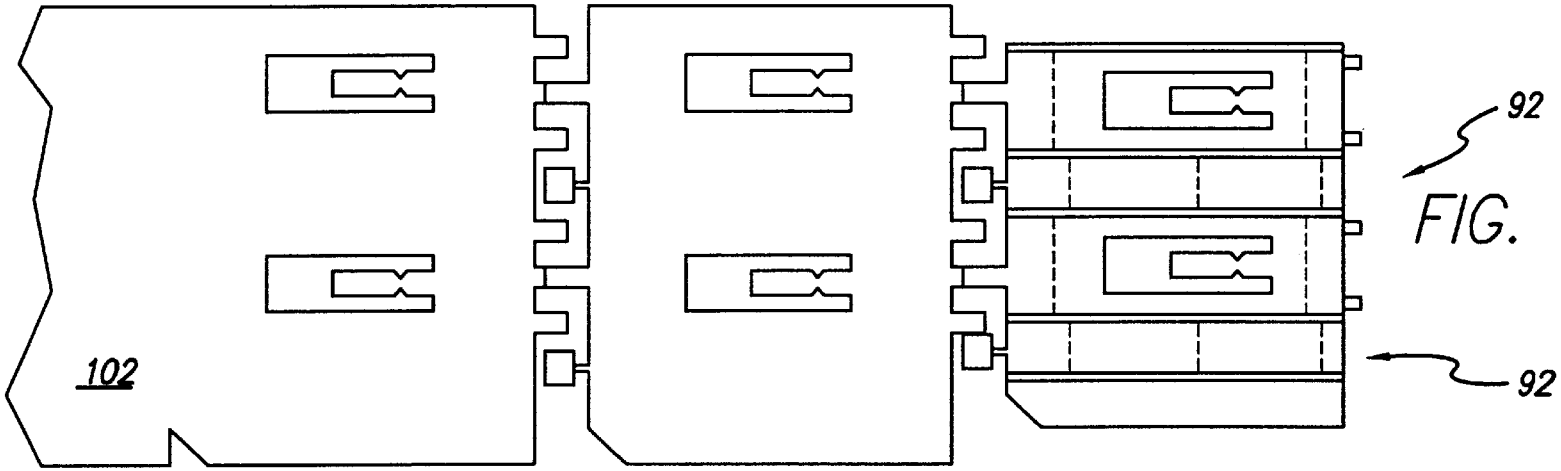
FIG. 25A is a top view of a first element composing an 'S'shaped structural vent formed in three manufacturing steps according to the present invention.
Figure 25B:
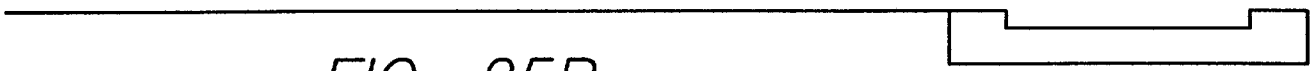
FIG. 25B is a side view of the element of FIG. 25A.
Figure 25C:
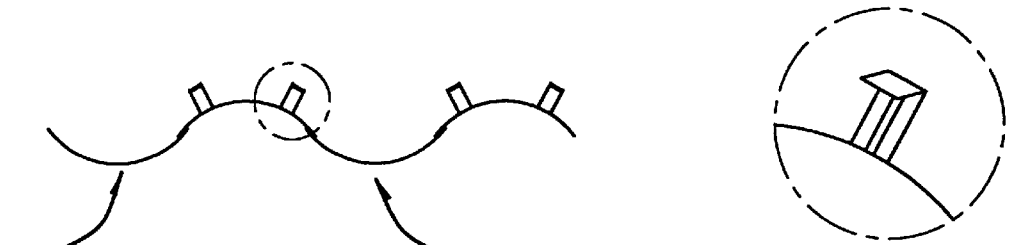
FIG. 25C is an end view of the element of FIG. 25A.
Figure 26A:
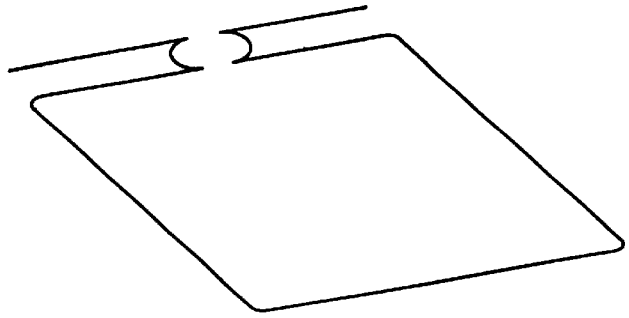
FIG. 26A is an isometric view of the first manufacturing step of forming a booster according to the present invention.
Figure 26B:
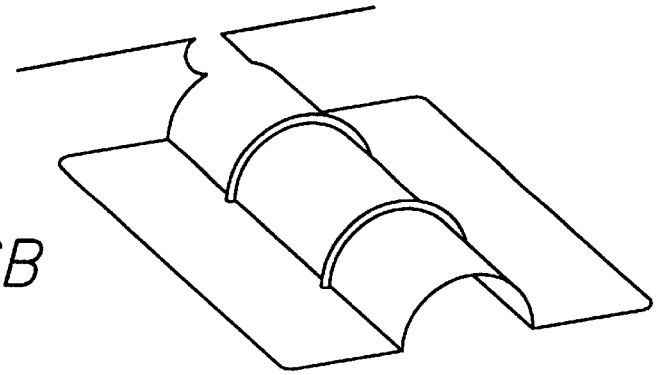
FIG. 26B is an isometric view of the second manufacturing step of forming the booster of FIG. 26A.
Figure 26C:
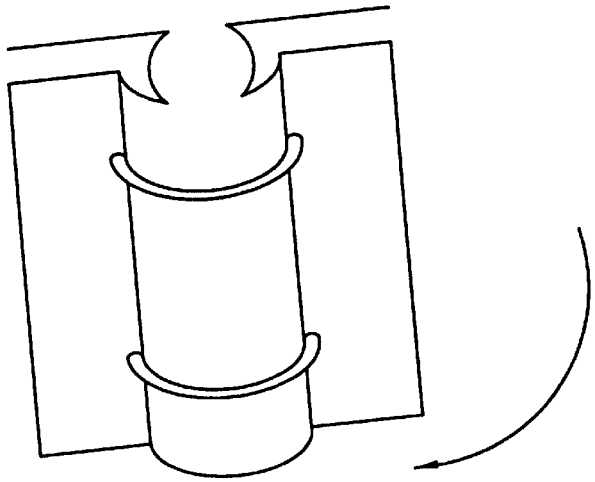
FIG. 26C is an isometric view of the third manufacturing step of forming the booster of FIG. 26A.
Figure 26D:
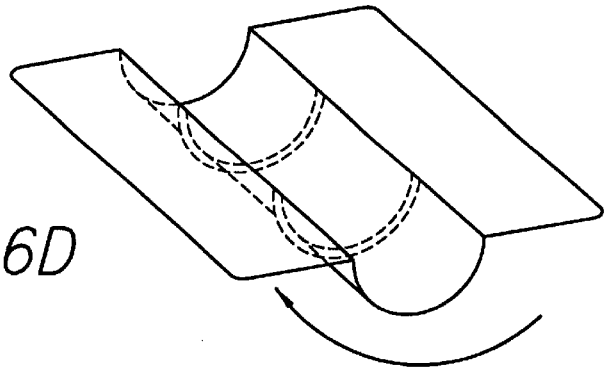
FIG. 26D is an isometric view of the fourth manufacturing step of forming the booster of FIG. 26A.
Figure 27:
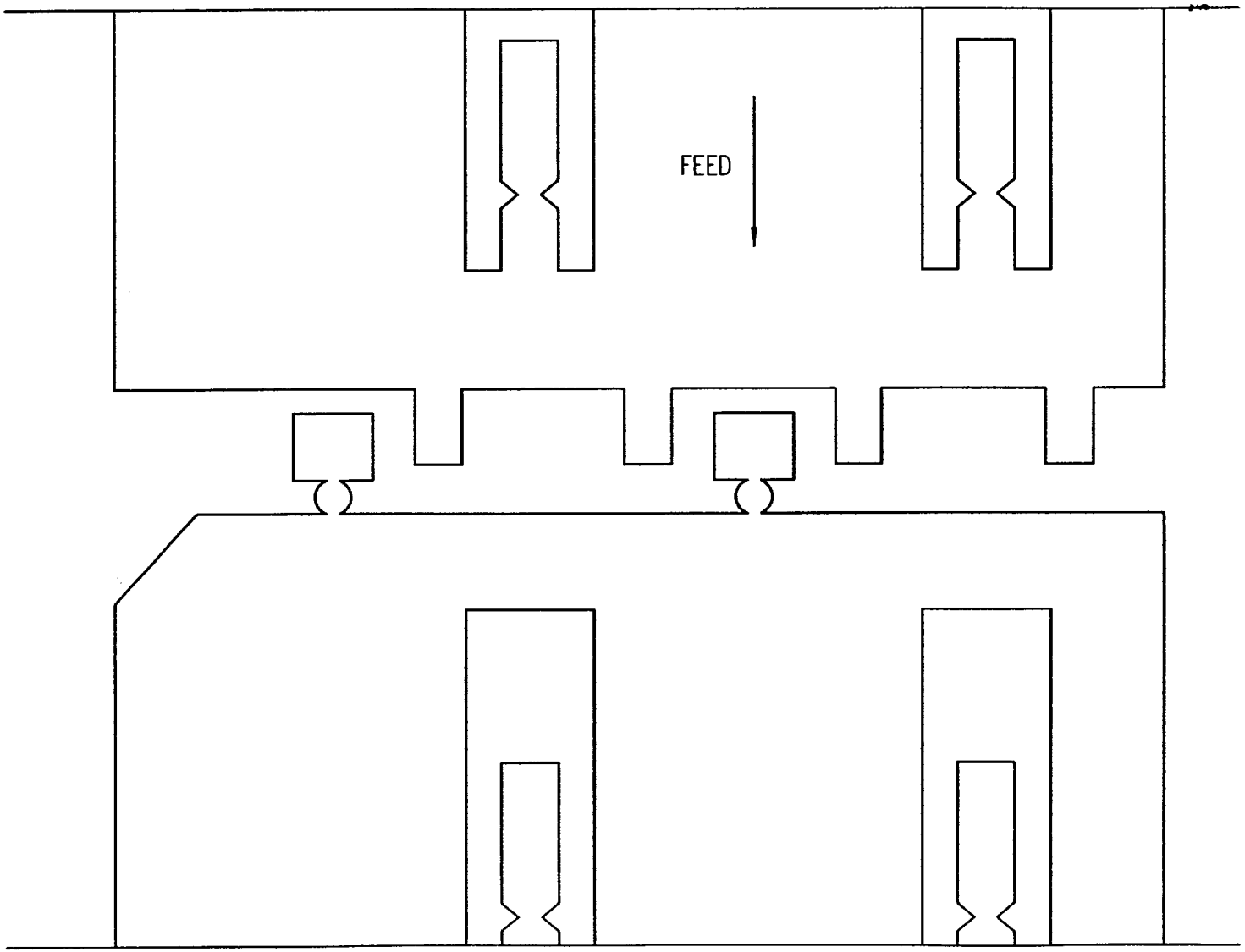
FIG. 27 is a top detail view of the element of FIG. 25A.
Figure 28:
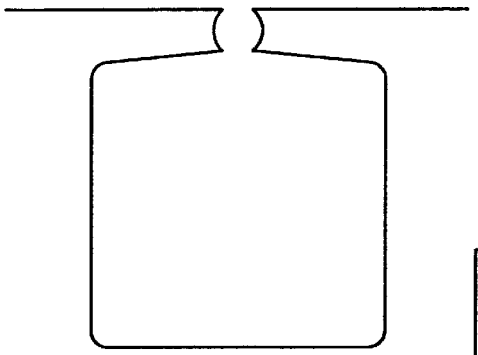
FIG. 28 is a top detail view of the booster of FIG. 26A.
Figure 29A:
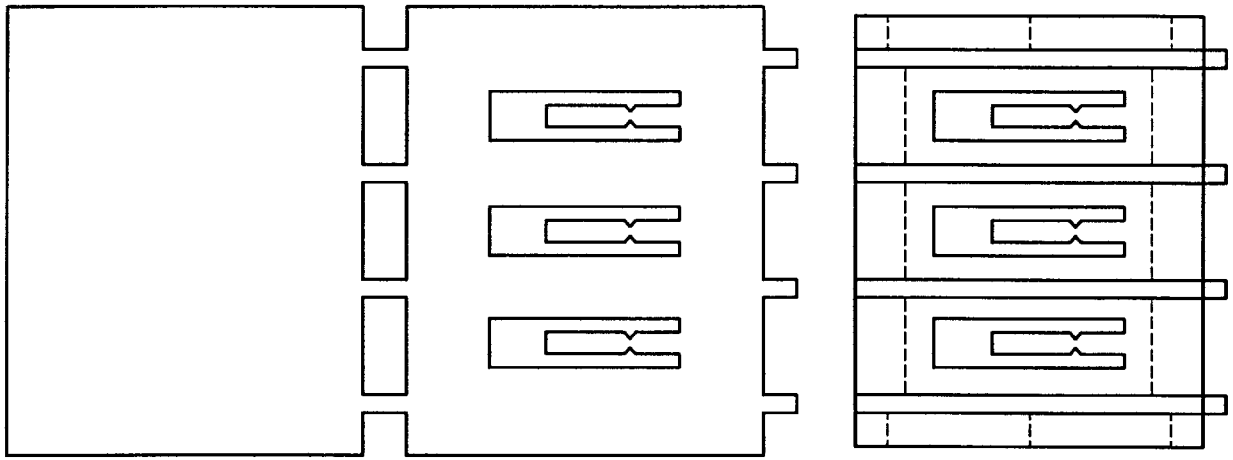
FIG. 29A is a top view of a first element composing an 'M' structural vent formed in three manufacturing steps according to the present invention.
Figure 29B:
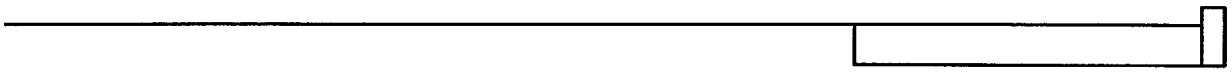
FIG. 29B is a side view of the element of FIG. 29A.
Figure 29C:
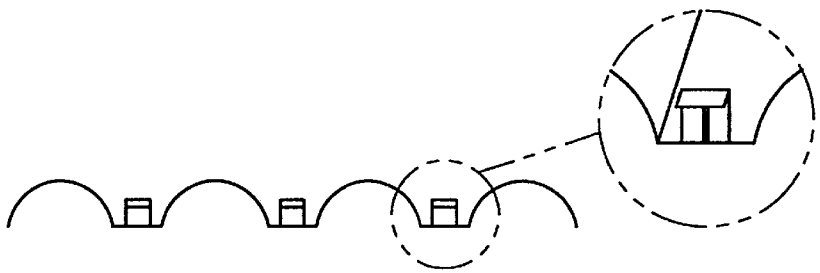
FIG. 29C is an end view of the element of FIG. 29A.
Figure 30A:
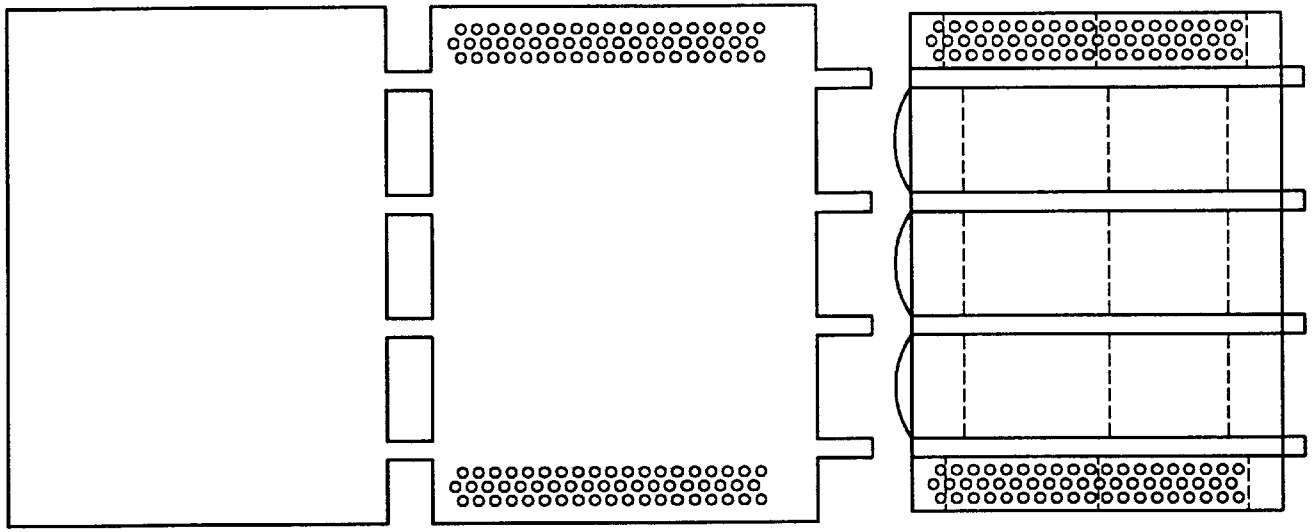
FIG. 30A is a top view of a second element composing an 'M' structural vent formed in three manufacturing steps according to the present invention.
Figure 30B:
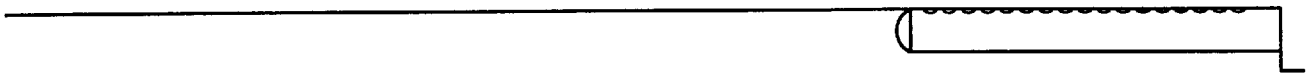
FIG. 30B is a side view of the element of FIG. 30A.
Figure 30C:
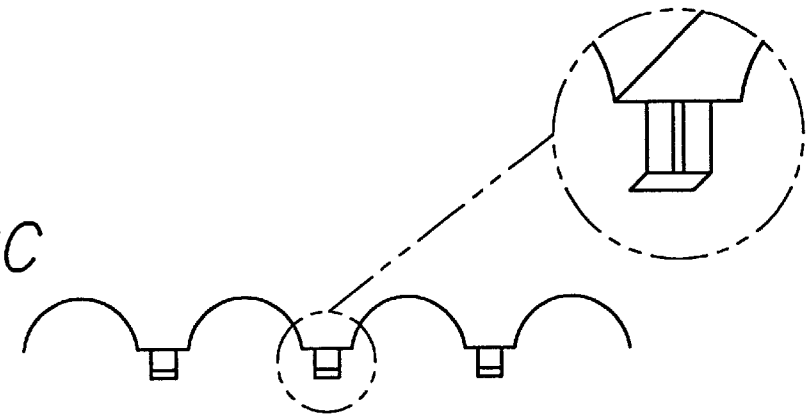
FIG. 30C is an end view of the element of FIG. 30A.

Referring now to FIG. 11, secondary vent 12 may include one or more caps 14 attached to lower piece or frame 16. Secondary vent 12 may serve as an alternate replacement for one or more conventional tiles 21 on pitched roof 11. Different tile types and similar looking tiles from different manufacturers have different physical dimensions and may require a unique frame configuration for a precise fit between the tiles and frame 16. Specific fit may be required between upslope edge 42 to upslope tile 21U, pan flange 24 to pan 25, and downslope edge 45 to downslope tile 13D and cap flange 22 to cap 23. Frame 16 may be formed to fit the contours and edge configuration of the field tiles 21 used. Frame 16 may be manufactured in any conventional manner. In a currently preferred embodiment of the present invention, and as shown in FIGS. 25A–25C, frame 16 is stamped from a single piece of material to fit precisely the field tiles 21 for which it is intended to be used. Frame 16 may include one or more pan areas 18 and a cap area 20 adjacent each pan area 18. Viewed from above, pan areas 18 are concave and cap areas 20 are convex. As shown in FIGS. 26A–26D, the pan and cap areas may also be formed from a flat sheet of material such as sheet metal that is stamped into a concave or convex channel or trough, including any ridges or reinforcing ribs that may be formed in the pan or cap. The concave or convex channel defining the pan or cap, respectively, may subsequently be further shaped such as by bending to further define the desired pan or cap shape and assume the desired dimensions. Pan areas 18 align with individual pan tiles or with corresponding pan areas of field tiles such as pan areas 17 of FIG. 10. Cap areas 20 align with individual cap tiles or with corresponding cap areas of field tiles 21 such as cap areas 19 of FIG. 10. Secondary vent 12 is mounted with pitch axis 31 parallel to the pitch of pitched roof 11.

Cap flange 22 is configured to fit underneath the cap of an adjacent field tile such as cap 23 as shown in FIG. 10. Cap flange 22 may include one or more creases such as crease 30 to obtain a precise fit to an adjacent field tile. Cap flange 22 may also have one or more bevels such as bevel 32 to minimize interference with an adjacent field tile. Pan flange 24 is configured to mate with the pan of an adjacent field tile such as pan 25 as shown in FIG. 10. Pan flange 24 may include one or more creases such as crease 28 (FIG. 12) to obtain a precise fit to an adjacent field tile. A plurality of ribs 26, 26A and 26B may be stamped into frame 16 for increased rigidity, as discussed above. In a currently preferred embodiment of the present invention ribs 26, 26A and 26B are parallel to upslope edge 42. A hole 34 is included in each pan area 18 to accept a conventional fastener, such as a nail or a screw, to secure secondary vent 12 to a roof such as pitched roof 11.

Figure 12:
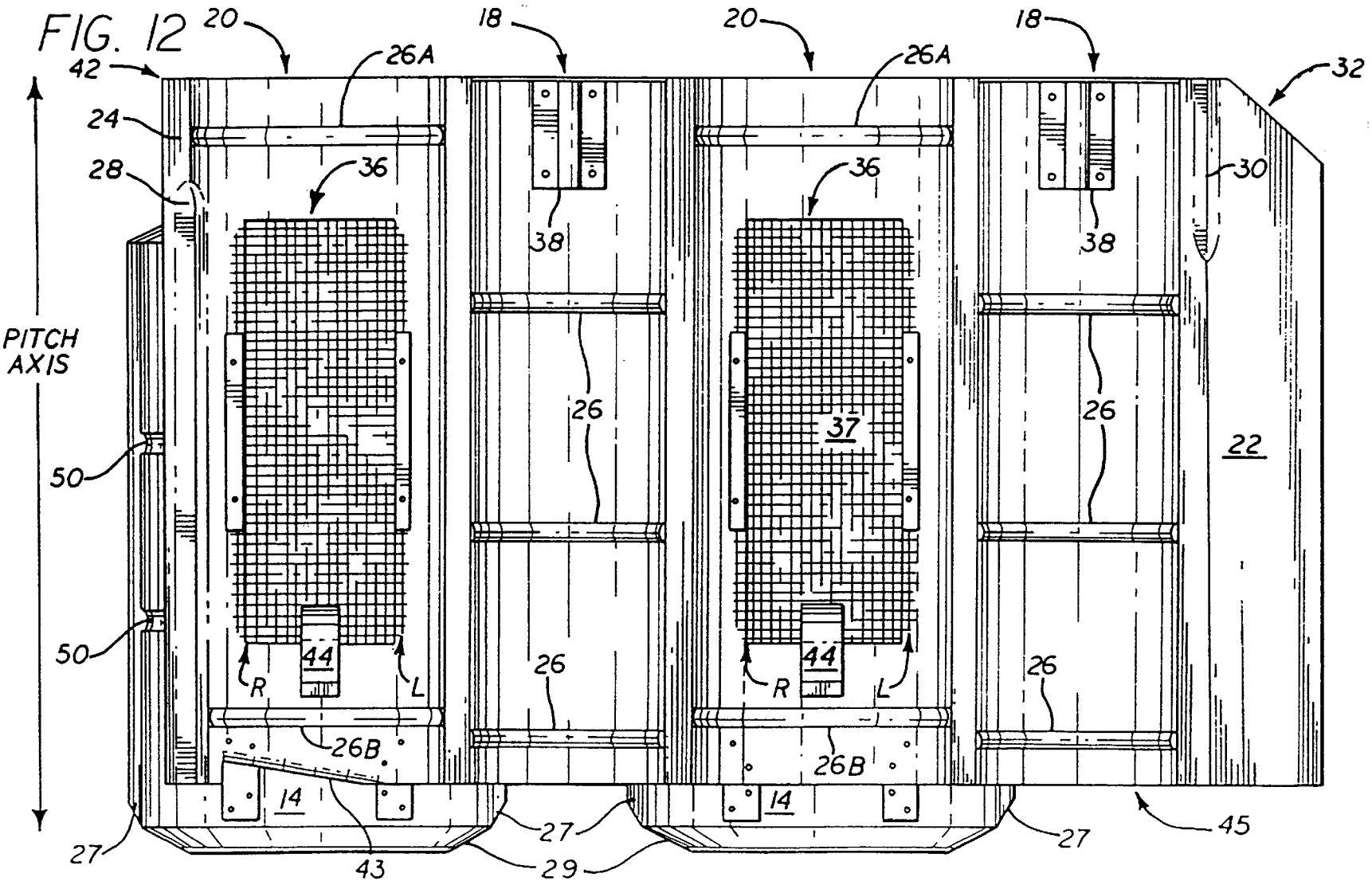
FIG. 12 is a bottom view of the secondary vent frame and caps of FIG. 11.

Referring now to FIG. 12, the underside of frame 16 is shown in more detail. Frame 16 includes a vent opening 36 in each cap area 20. When installed on a roof near a primary vent, vent openings 36 are in ventilating communication with vent opening 46. Each vent opening 36 is located between ribs 26A and 26B.

Where tile 85 is not composed of two generally similar parallel surfaces such as on secondary vent 12, booster 38 may be attached to each pan area 18 adjacent edge 40. Booster 38 is a spacer that compensates for the difference in thickness between field tiles 21 and frame 16. Booster 38 may be formed and attached in any conventional manner to raise frame 16 above the roof battens such as batten B. Thickness compensating fingers 43 are formed along the downslope edge 45 of cap area 20. Thickness compensating fingers 43 compensate for the difference in thickness between field tiles 21 and frame 16 to provide a seal against the top of a downslope field tile such as downslope tile 13D. Wind clips 44 are attached to frame 16 to secure secondary vent 12 to lower course tiles 45 shown in FIG. 20.

Figure 13:
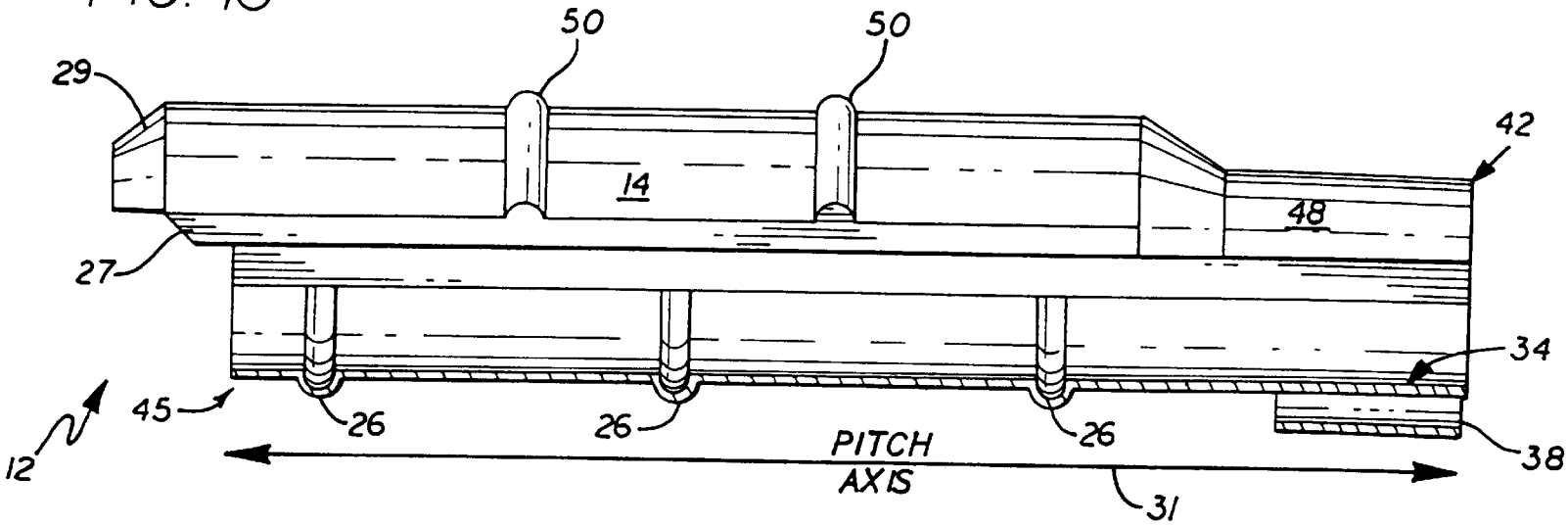
FIG. 13 is a cross-section view of the secondary vent frame and caps of FIG. 11 taken along 4—4.
Figure 14:
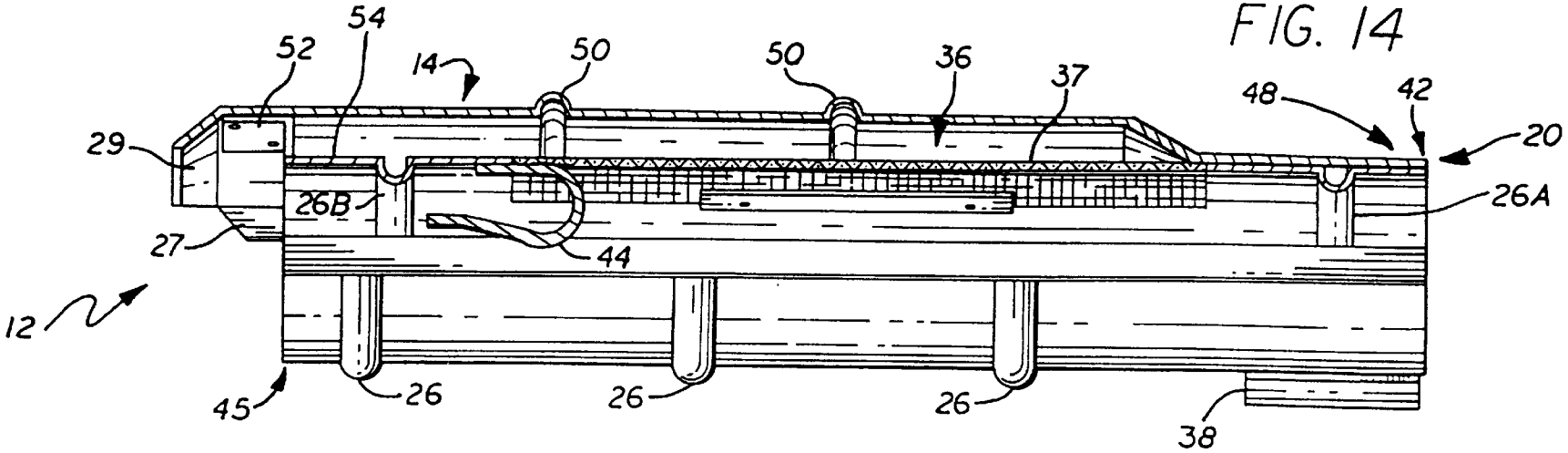
FIG. 14 is a cross-section view of the secondary vent frame and caps of FIG. 11 taken along 5—5.

Referring now to FIGS. 13 and 14, ribs 26, 26A, 26B, 50 and booster 38 are seen in profile. Ribs 26 are shown as concave, but other configurations may be equally suitable. Rib 26B is shown as convex, but other configurations may be equally suitable. Rib 26A must be oriented concave up to minimize interference with caps 14 at shoulder 48. Ribs 50 are shown as concave down, but other configurations may be equally suitable. Legs 52 are attached to frame 16 and to caps 14 to support caps 14 and maintain ventilating access 54 between frame 16 and caps 14. Legs 52 may be attached in any conventional manner.

Caps 14 shield vent openings 36 from the weather and are attached to cap area 20 by any conventional means such as riveting or spot welding at shoulder 48 and legs 52. Caps 14 include side hems 27, a front hem 29, and ribs 50. In a currently preferred embodiment of the present invention, ribs 50 extend parallel to front hem 29 from one side hem 27 to the other side hem 27. Side hems 27 and front hem 29 are included to improve the weather shielding efficiency of cap 14 without sacrificing ventilating efficiency. Ribs 50 and are stamped into caps 14 for rigidity. Front and side hems 29 and 27 may be made in any conventional manner such as cutting and bending. In a currently preferred embodiment of the present invention, front and side hems 29 and 27 are formed by stamping to increase the rigidity of caps 14, and caps 14 are made in one standard size. A standard size cap 14 may be fitted to many different frames thus minimizing manufacturing and inventory complexity.

Figure 15:
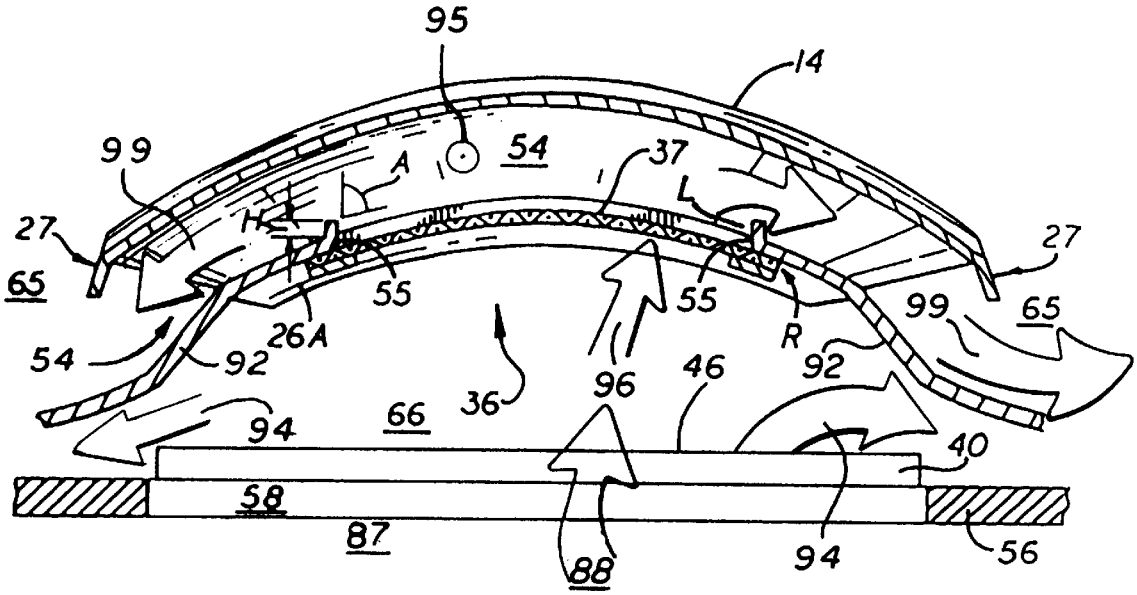
FIG. 15 is a cross-section view of the secondary vent frame and caps of FIG. 11 taken along 6—6.

Referring now to FIG. 15, the uniform relationship between frame 16 and top surface or cap 14 is shown. Vent 10 serves dual purposes, ventilating attic 87 and protecting attic 87 from weather and pests. Vent opening 36, vent opening 46 and attic opening 58 cooperate to conduct attic air 88 from attic 87. A parallel top surface 85T or caps such as cap 14 are attached to frame 16 as shields over vent opening 36 to prevent weather and pests from falling directly into attic 87. Caps 14 also prevent direct solar irradiation of felt 4 or attic 87. Vent openings 36 are covered by screen 37 to prevent entry into twining chamber 66 by pests larger than the screen openings. Baffles 55 shield vent openings 36 from wind driven moisture and particles, and extend along edges R and L. Baffles 55 are H high and they are folded up along angle A between 0° and 90° from vent opening 36. In a currently preferred embodiment of the present invention, H is 0.25" and angle A is 50°. Cap 14 includes side hems 27, and a front hem 29 (shown in FIG. 16) to further shield vent opening 36 from entry of foreign matter. Side hems 27, and front hem 29 extend from cap 14 to below vent opening 36.

Attic air 88 flowing through a passive vent such as vent 10 follows the same path whether from outside 65 into attic 87, or from within the attic 87 to outside 65, only the direction of flow changes. For the sake of simplicity, attic air 88 flow from attic 87 to outside 65 will now be described with the understanding that the present invention functions equally well conducting air in both directions. Air travelling through vent 10 must undergo a change of direction that helps to prevent foreign matter from entering attic 87. As installed, vent opening 46 of primary vent 40 provides a convection driven ventilating channel through roof deck 56. Primary vent 40 conducts air up from within attic 87 through attic opening 58 and vent opening 46 to twining chamber 66. In twining chamber 66 attic air 88 is diverted by frame diverters such as diverter 92 into secondary flow 96 and primary flow 94. Convection continues to drive secondary flow 96 up through vent opening 36 into ventilating access 54. Secondary flow 96 in ventilating access 54 is then conducted up over baffles 55. Once above baffles 55 the shape of vent cap 14 and hems 27 and 29 cause secondary flow 96 to change direction and divide and travel down beyond side hems 27 as side air 99 or front hem 29 as front air 95 to outside 65.

Figure 16:
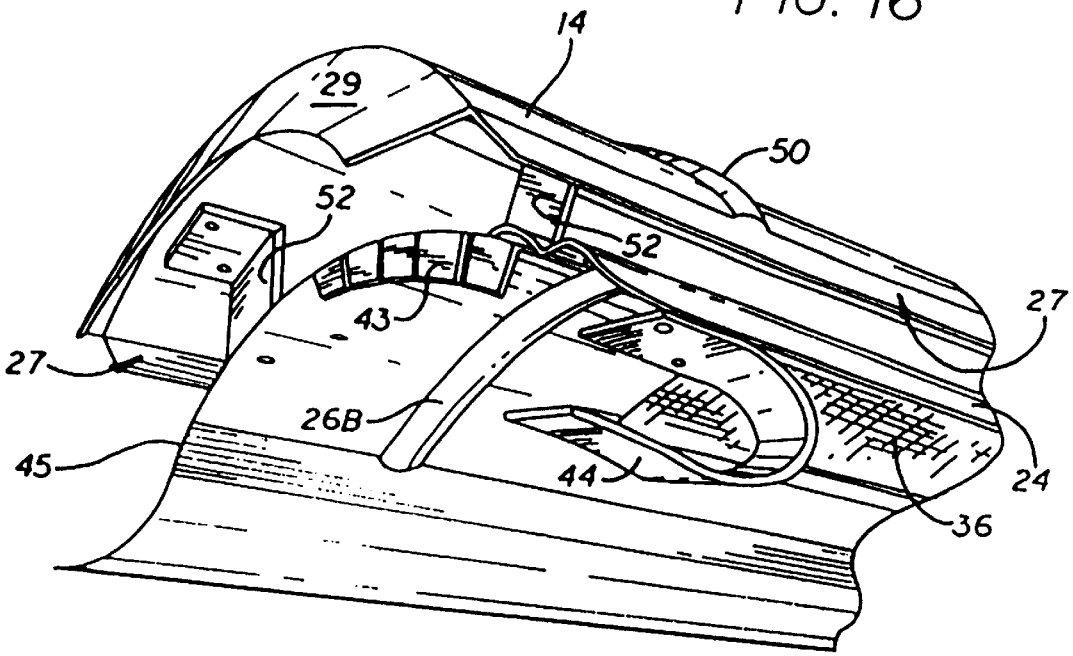
FIG. 16 is a perspective view from below of the front cap corner of a secondary vent frame and cap according to the present invention.

Referring now to FIG. 16, thickness compensating fingers 43 and a wind clip 44 are shown in more detail. Thickness compensating fingers 43 may be formed by any conventional means, and in a currently preferred embodiment of the present invention thickness compensating fingers 43 are cut into downslope edge 45 of cap area 20 and folded. Due to the thickness disparity between frame 16 and adjacent field tiles 21, thickness compensating fingers 43 are needed to provide a pest seal against the top of the down slope field tile 21 when pan flange 24 is fitted to the pan of an adjacent field tile such as pan 25 as shown in FIG. 10.

Figure 20:
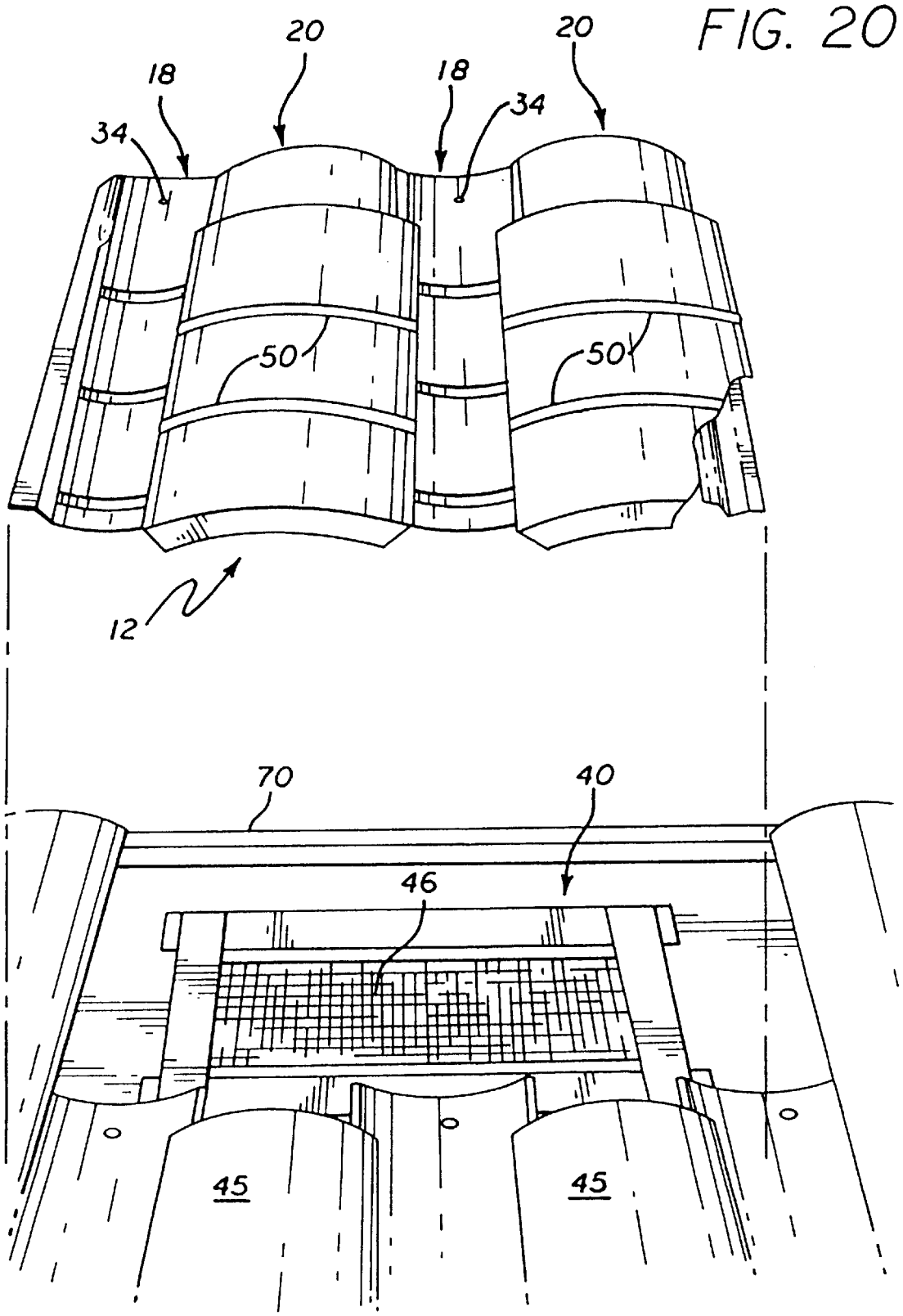
FIG. 20 is a perspective view of an installed primary vent showing the relationship to a secondary vent according to the present invention.

In FIGS. 17–20 installation steps for roof vent 10 are illustrated as a general example. Referring now to FIG. 17, location 57 on roof deck 56 is selected for installation of roof vent 10. Location 57 is marked to delineate where attic opening 58 will be cut. As shown in FIG. 18, saw 59 is used to cut attic opening 58 through roof deck 56. In FIG. 19, sealant 61 is applied to bottom side 41 of primary vent 40. Primary vent 40 is installed with bottom side 41 in contact with roof deck 56 and vent opening 46 in ventilating communication with attic opening 58. As shown in FIG. 20, secondary vent 12 is then installed above primary vent 40 with vent openings 36 in ventilation communication with vent opening 46. Vent opening 46 may be provided with screen 46S for additional protection against introduction of vermin or debris through attic opening 58. Fasteners (not shown) are attached through holes 34 into batten 70 to secure secondary vent 12.

To maximize attic ventilation, roof vents 10 may be used in pairs. A pair of roof vents 10 may be located on a roof parallel to the rafters with a first roof vent 10 near the roof peak (not shown) and a second roof vent 10 near eave 60. This configuration promotes passive air convection through the attic or rafter space as warm air rises through the first roof vent 10 cooler air is drawn into the attic or rafter space through second roof vent 10.

Figure 21A:
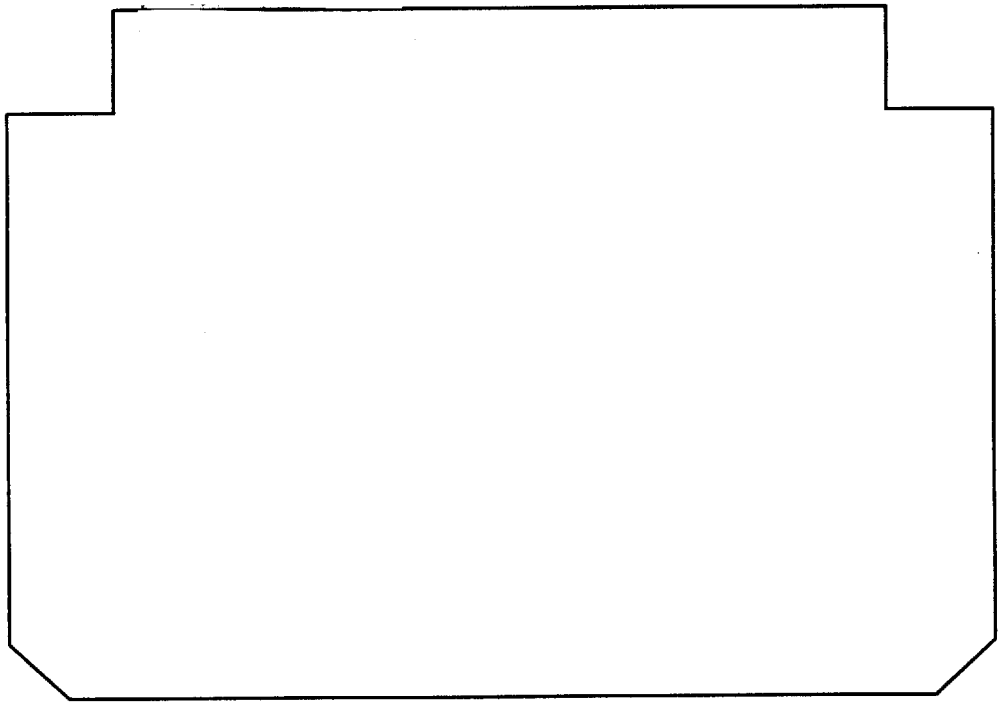
FIG. 21A is a top view of a first element composing a flat structural vent after a first manufacturing step according to the present invention.
Figure 21B:
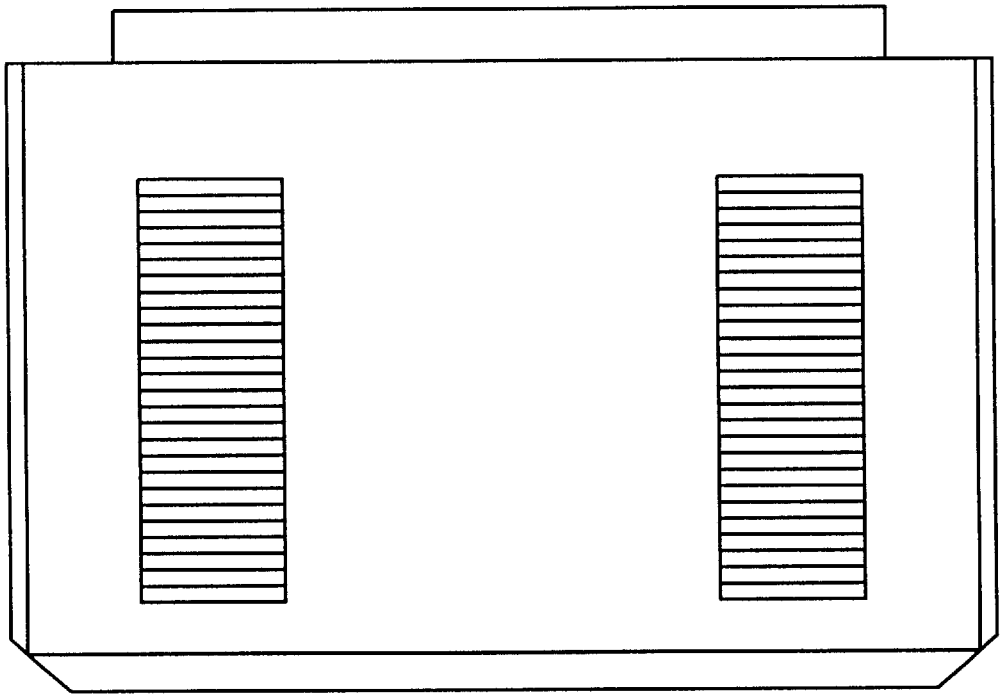
FIG. 21B is a top view of the first element of FIG. 21A after a second manufacturing step according to the present invention.

Referring now to FIG. 21, in a currently preferred embodiment of the present invention a structural ventilation tile such as tile 85 may be formed of a single contiguous piece of material.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims.

I claim:

1. A roof ventilation system for a sloped roof, comprising:

a sloped structural layer having an upper surface, a lower surface, and two or more primary vents extending between the lower surface and the upper surface; and a plurality of roofing tile elements mounted over the structural layer upper surface to form a ventilation layer therebetween in ventilating communication with the two or more primary vents;

one or more primary vents disposed near an upslope edge of the sloped roof; and one or more primary vents disposed near a downslope edge of the sloped roof.

2. The invention as claimed in claim 1, wherein one of the tile elements further comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

3. The invention as claimed in claim 1, wherein each of said one or more vent frame openings further comprises:

a permeable surface.

4. The invention as claimed in claim 3, wherein said permeable surface further comprises:

a wire screen.

5. The invention as claimed in claim 3, wherein each of said one or more vent frame openings further comprises:

one or more flanges to prevent moisture incursion.

6. The invention as claimed in claim 3, wherein each of said one or more vent frame openings further comprises:

one or more baffles to prevent moisture incursion.

7. The invention as claimed in claim 3, wherein each of said one or more vent frame openings further comprises:

one or more ridges to prevent moisture incursion.

8. The invention as claimed in claim 3, wherein the vent cap and the vent frame are joined at an angle.

9. The invention as claimed in claim 3, wherein the vent frame further comprises:

one or more tapered flanges.

10. The invention claimed in claim 3, wherein said upslope and downslope edges are configured to form a precise fit against said overlapping upslope and downslope tiles respectively.

11. The invention claimed in claim 3, wherein said vent frame has a cap flange configured to form a precise fit under and against a cap of an overlapping tile.

12. The invention claimed in claim 3, wherein said vent frame has a pan flange configured to form a precise fit against a pan of an overlapping tile.

13. The invention claimed in claim 3, wherein said vent frame and said vent cap are mounted together to form an S-shaped tile.

14. The invention claimed in claim 3, wherein said vent frame and said roof vent caps are mounted together in the shape of double-wide roof tiles.

15. The invention claimed in claim 3, wherein said vent frame and said vent caps are mounted together in the shape of the surrounding roof tiles.

16. The invention claimed in claim 3, wherein:

said primary vent, vent frame, and vent caps are painted or fused with color to match the surrounding roof tiles.

17. A roof ventilation system for a roof of that type in which a water resistant layer is fixed to the upper surface of a sloped structural layer, and a roof shield layer composed of clay, concrete, slate or metal tiles is fixed to the upper surface of the water resistant layer to form a ventilation layer therebetween, wherein the improvement comprises:

one or more primary vents extending through the waterproof layer and the sloped structural layer to form a ventilation path therethrough to the ventilation layer; and one or more secondary vent tiles secured in the roof shield layer and in ventilating communication with the ventilation layer.

18. A ventilated roof, comprising:

a roof structural layer through which air is to be ventilated;

a primary vent disposed in the structural layer to provide an air flow passage therethrough having a first venting performance;

a plurality of tiles mounted on the structural layer to form a tile layer thereover and arranged to provide air flow passages between adjacent tiles having a combined second venting performance; and a secondary vent disposed in the tile layer to form an outer roofing layer therewith and having an air passage therethrough with a third venting performance smaller than the first venting performance, the outer roofing layer being in air flow communication with the primary vent to provide a venting air flow passage for venting said air.

19. The invention of claim 18, wherein the venting air flow passage has a fourth venting performance greater than the second venting performance.

20. The invention of claim 18 or 19, wherein the secondary vent further comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

21. The invention of claim 20, wherein the vent frame and the vent cap are formed as an integral structure.

22. The invention of claim 20, wherein the vent cap is mounted at an angle to the vent frame.

23. The invention of claim 20, further comprising:

a permeable surface disposed over each vent frame opening.

24. The invention of claim 23, wherein the permeable surface further comprises:

wire screen.

25. The invention of claim 20, wherein each vent frame opening further comprises:

one or more flanges to prevent moisture incursion.

26. The invention of claim 20, wherein each vent frame opening further comprises:

one or more baffles to prevent moisture incursion.

27. The invention of claim 20, wherein each vent frame opening further comprises:

one or more ridges to prevent moisture incursion.

28. The invention of claim 20, further comprising:

a water repellant layer secured to the structural layer upper surface.

29. A method for ventilating a roof, comprising the steps of:

providing a roof structural layer through which air is to be ventilated;

selecting a primary vent having a first venting performance;

mounting the primary vent in the structural layer to provide an air flow passage therethrough;

selecting a plurality of tiles;

arranging the tiles on the structural layer to provide air flow passages between adjacent tiles;

mounting the tiles on the structural layer to form a tile layer thereover having a combined second venting performance;

selecting a secondary vent having an air passage therethrough with a third venting performance smaller than the first venting performance; and mounting the secondary vent in the tile layer to form an outer roofing layer therewith in air flow communication with the primary vent to provide a venting air flow passage for venting said air.

30. The method of claim 29, wherein the venting air flow passage has a fourth venting performance greater than the second venting performance.

31. The method of claim 29 or 30, wherein the step of selecting a secondary vent includes selecting a secondary vent that comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

32. The method of claim 31, wherein the step of selecting a secondary vent includes selecting a secondary vent wherein the vent frame and the vent cap are formed as an integral structure.

33. The method of claim 31, wherein the step of selecting a secondary vent includes selecting a secondary vent wherein the vent cap is mounted at an angle to the vent frame.

34. The method of claim 31, wherein the step of selecting a secondary vent includes selecting a secondary vent further comprising:

a permeable surface disposed over each vent frame opening.

35. The method of claim 34, wherein the step of selecting a secondary vent includes selecting a secondary vent wherein the permeable surface further comprises:

wire screen.

36. The method of claim 31, wherein the step of selecting a secondary vent includes selecting a secondary vent wherein each vent frame opening further comprises:

one or more flanges to prevent moisture incursion.

37. The method of claim 31, wherein the step of selecting a secondary vent includes selecting a secondary vent wherein each vent frame opening further comprises:

one or more baffles to prevent moisture incursion.

38. The method of claim 31, wherein the step of selecting a secondary vent includes selecting a secondary vent wherein each vent frame opening further comprises:

one or more ridges to prevent moisture incursion.

39. The method of claim 31, comprising the further step of:

securing a water repellant layer to the structural layer upper surface.

40. A ventilated roof, comprising:

a roof structural layer through which air is to be ventilated from an attic;

a primary vent disposed in the structural layer to provide an air flow passage therethrough having a first venting performance;

a plurality of tiles mounted on the structural layer to form a tile layer thereover and arranged to provide air flow passages between adjacent tiles having a combined second venting performance; and a secondary vent disposed in the tile layer to form an outer roofing layer therewith and having an air passage therethrough with a third venting performance, the outer roofing layer being in air flow communication with the primary vent to provide a venting air flow passage having a fourth venting performance greater than the second venting performance for venting the air from the attic.

41. The invention of claim 40, wherein the third venting performance is smaller than the first venting performance.

42. The invention of claim 40 or 41, wherein the secondary vent further comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

43. The invention of claim 42, wherein the vent frame and the vent cap are formed as an integral structure.

44. The invention of claim 42, wherein the vent cap is mounted at an angle to the vent frame.

45. The invention of claim 42, further comprising:

a permeable surface disposed over each vent frame opening.

46. The invention of claim 45, wherein the permeable surface further comprises:

wire screen.

47. The invention of claim 42, wherein each vent frame opening further comprises:

one or more flanges to prevent moisture incursion.

48. The invention of claim 42, wherein each vent frame opening further comprises:

one or more baffles to prevent moisture incursion.

49. The invention of claim 42, wherein each vent frame opening further comprises:

one or more ridges to prevent moisture incursion.

50. The invention of claim 42, further comprising:

a water repellant layer secured to the structural layer upper surface.

51. A method for ventilating a roof, comprising the steps of:

providing a roof structural layer through which air is to be ventilated;

selecting a primary vent having a first venting performance;

mounting the primary vent in the structural layer to provide an air flow passage therethrough;

selecting a plurality of tiles;

arranging the tiles on the structural layer to provide air flow passages between adjacent tiles;

mounting the tiles on the structural layer to form a tile layer thereover having a combined second venting performance;

selecting a secondary vent having an air passage therethrough with a third venting performance; and mounting the secondary vent in the tile layer to form an outer roofing layer therewith in air flow communication with the primary vent to provide a venting air flow passage having a fourth venting performance greater than the second venting performance for venting said air.

52. The method of claim 51, wherein the third venting performance is smaller than the first venting performance.

53. The method of claim 51 or 52, wherein the step of selecting a secondary vent includes selecting a secondary vent that comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

54. The method of claim 53, wherein the step of selecting a secondary vent includes selecting a secondary vent wherein the vent frame and the vent cap are formed as an integral structure.

55. The method of claim 53, wherein the step of selecting a secondary vent includes selecting a secondary vent wherein the vent cap is mounted at an angle to the vent frame.

56. The method of claim 53, wherein the step of selecting a secondary vent includes selecting a secondary vent further comprising:

a permeable surface disposed over each vent frame opening.

57. The method of claim 56, wherein the step of selecting a secondary vent includes selecting a secondary vent wherein the permeable surface further comprises:

wire screen.

58. The method of claim 53, wherein the step of selecting a secondary vent includes selecting a secondary vent wherein each vent frame opening further comprises:

one or more flanges to prevent moisture incursion.

59. The method of claim 53, wherein the step of selecting a secondary vent includes selecting a secondary vent wherein each vent frame opening further comprises:

one or more baffles to prevent moisture incursion.

60. The method of claim 53, wherein the step of selecting a secondary vent includes selecting a secondary vent wherein each vent frame opening further comprises:

one or more ridges to prevent moisture incursion.

61. The method of claim 53, comprising the further step of:

securing a water repellant layer to the structural layer upper surface.

62. A ventilated roof, comprising:

a roof structural layer through which air is to be ventilated;

a primary vent disposed in the structural layer to provide an air flow passage therethrough having a first venting performance;

a secondary vent disposed in the tile layer and having an air passage therethrough with a third venting performance smaller than the first venting performance, the tile layer and secondary vent being in air flow communication with the primary vent to provide a venting air flow passage having a combined fourth venting performance approximately equal to the first venting performance for venting the air; and a plurality of tiles mounted on the structural layer to form a tile layer thereover and arranged to provide air flow passages between adjacent tiles in air flow communication with the primary vent to vent the air and having a combined venting performance.

63. The invention of claim 62, wherein the secondary vent further comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

64. The invention of claim 63, wherein the vent frame and the vent cap are formed as an integral structure.

65. The invention of claim 63, wherein the vent cap is mounted at an angle to the vent frame.

66. The invention of claim 63, further comprising:

a permeable surface disposed over each vent frame opening.

67. The invention of claim 66, wherein the permeable surface further comprises:

wire screen.

68. The invention of claim 63, wherein each vent frame opening further comprises:

one or more flanges to prevent moisture incursion.

69. The invention of claim 63, wherein each vent frame opening further comprises:

one or more baffles to prevent moisture incursion.

70. The invention of claim 63, wherein each vent frame opening further comprises:

one or more ridges to prevent moisture incursion.

71. The invention of claim 63, further comprising:

a water repellant layer secured to the structural layer upper surface.

72. A method for ventilating a roof, comprising the steps of:

providing a roof structural layer through which air is to be ventilated;

selecting a primary vent having a first venting performance;

mounting the primary vent in the structural layer to provide an air flow passage therethrough;

selecting a plurality of tiles;

arranging the tiles on the structural layer to provide air flow passages between adjacent tiles in air flow communication with the primary vent; and mounting the tiles on the structural layer to form a tile layer thereover having a combined second venting performance.

73. The method of claim 72, wherein the second venting performance is approximately equal to the first venting performance.

74. The method of claim 72, comprising the further steps of:

selecting a secondary vent having an air passage therethrough with a third venting performance smaller than the first venting performance; and mounting the secondary vent in the tile layer to form an outer roof layer therewith in air flow communication with the primary vent to provide a venting air flow passage having a combined fourth venting performance approximately equal to the first venting performance for venting the air.

75. The method of claim 74, wherein the step of selecting a secondary vent includes selecting a secondary vent that comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

76. The method of claim 75, wherein the step of selecting a secondary vent includes selecting a secondary vent wherein the vent frame and the vent cap are formed as an integral structure.

77. The method of claim 75, wherein the step of selecting a secondary vent includes selecting a secondary vent wherein the vent cap is mounted at an angle to the vent frame.

78. The method of claim 75, wherein the step of selecting a secondary vent includes selecting a secondary vent further comprising:

a permeable surface disposed over each vent frame opening.

79. The method of claim 78, wherein the step of selecting a secondary vent includes selecting a secondary vent wherein the permeable surface further comprises:

wire screen.

80. The method of claim 75, wherein the step of selecting a secondary vent includes selecting a secondary vent wherein each vent frame opening further comprises:

one or more flanges to prevent moisture incursion.

81. The method of claim 75, wherein the step of selecting a secondary vent includes selecting a secondary vent wherein each vent frame opening further comprises:

one or more baffles to prevent moisture incursion.

82. The method of claim 75, wherein the step of selecting a secondary vent includes selecting a secondary vent wherein each vent frame opening further comprises:

one or more ridges to prevent moisture incursion.

83. The method of claim 75, comprising the further step of:

securing a water repellant layer to the structural layer upper surface.

84. A ventilated roof, comprising:

a first roofing layer having a primary vent through which air from an attic is to be ventilated; and a second roofing layer constructed from a plurality of similar roofing tile elements disposed over the first roofing layer and having an effective third vent in air flow communication with the primary vent to vent said attic, said effective third vent combining air flow passages between the tile elements; and a secondary vent disposed in the second roofing layer and including an airflow passage therethrough so that the effective third vent combines the air flow passages between the tile elements with the air flow passage through the secondary vent.

85. The invention of claim 84, wherein the secondary vent further comprises:

a vent frame with one or more vent frame openings in ventilating communication with a primary vent, an exposed pan section forming a segment of a pan channel, and a cap section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

86. The invention of claim 85, wherein the vent frame and the vent cap are formed as an integral structure.

87. The invention of claim 85, wherein the vent cap is mounted at an angle to the vent frame.

88. The invention of claim 85, further comprising:

a permeable surface disposed over each vent frame opening.

89. The invention of claim 88, wherein the permeable surface further comprises:

wire screen.

90. The invention of claim 85, wherein each vent frame opening further comprises:

one or more elements selected from the group of elements consisting of flanges, baffles, and ridges, to prevent moisture incursion.

91. A method for ventilating a roof, comprising the steps of:

selecting a first roofing layer having a primary vent through which air from an attic is to be ventilated;

selecting a plurality of similar roofing tile elements; and disposing the tile elements over the first roofing layer to form a second roofing layer having an effective third vent in air flow communication with the primary vent to vent said attic, said effective third vent combining air flow passages between the tile elements;

selecting a secondary vent with an airflow passage therethrough; and disposing the secondary vent in the second roofing layer so that the effective third vent combines the air flow passages between the tile elements with the air flow passage through the secondary vent.

92. The method of claim 91, wherein the step of selecting the secondary vent includes selecting a secondary vent that comprises:

a vent frame with one or more vent frame openings in ventilating communication with a primary vent, an exposed pan section forming a segment of a cap column, the pan and cap sections being overlapped by tile elements in an upslope row of tile elements and tile elements in a downslope row of tile elements; and a vent cap having an elongated axis parallel to the cap column and extending from the portion of the cap section overlapped by tile elements in the upslope row to form a vent opening in ventilating communication with the one or more vent frame openings.

93. The method of claim 92, wherein the step of selecting the secondary vent includes selecting a secondary vent wherein the vent frame and the vent cap are formed as an integral structure.

94. The method of claim 92, wherein the step of selecting the secondary vent includes selecting a secondary vent wherein the vent cap is mounted at an angle to the vent frame.

95. The method of claim 92, wherein the step of selecting the secondary vent includes selecting a secondary vent comprising:

a permeable surface disposed over each vent frame opening.

96. The method of claim 95, wherein the step of selecting the secondary vent includes selecting a secondary vent wherein the permeable surface further comprises:

wire screen.

97. The method of claim 92, wherein the step of selecting the secondary vent includes selecting a secondary vent wherein each vent frame opening further comprises:

one or more elements selected from the group of elements consisting of flanges, baffles, and ridges, to prevent moisture incursion.

* * * * *